US008257094B2

(12) United States Patent
Ikeuchi et al.

(10) Patent No.: US 8,257,094 B2
(45) Date of Patent: Sep. 4, 2012

(54) CONNECTION TERMINAL AND TRANSMISSION LINE

(75) Inventors: Tadashi Ikeuchi, Kawasaki (JP); Takatoshi Yagisawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 100 days.

(21) Appl. No.: 12/776,969

(22) Filed: May 10, 2010

(65) Prior Publication Data

US 2010/0285676 A1 Nov. 11, 2010

(30) Foreign Application Priority Data

May 9, 2009 (JP) ..... 2009-114060

(51) Int. Cl.
*H01R 12/00* (2006.01)

(52) U.S. Cl. ..... 439/65; 439/59

(58) Field of Classification Search ..... 439/59, 439/65, 74, 606; 361/776, 791
See application file for complete search history.

(56) References Cited

U.S. PATENT DOCUMENTS

| | | | | |
|---|---|---|---|---|
| 3,591,834 | A * | 7/1971 | Kolias | 361/791 |
| 4,732,565 | A * | 3/1988 | Ito et al. | 439/79 |
| 5,241,454 | A * | 8/1993 | Ameen et al. | 361/744 |
| 5,429,510 | A * | 7/1995 | Barraclough et al. | 439/59 |
| 5,714,801 | A * | 2/1998 | Yano et al. | 257/691 |
| 7,077,658 | B1 * | 7/2006 | Ashman et al. | 439/65 |
| 7,090,502 | B2 * | 8/2006 | Ono et al. | 439/65 |
| 7,390,193 | B2 * | 6/2008 | Hsieh | 439/65 |
| 7,637,749 | B2 * | 12/2009 | Lang et al. | 439/65 |
| 7,819,673 | B2 * | 10/2010 | Hirashima | 439/74 |

FOREIGN PATENT DOCUMENTS

| | | |
|---|---|---|
| EP | 0596313 | 5/1994 |
| JP | 5-62984 U | 8/1993 |
| JP | 6-215819 A | 8/1994 |
| JP | 2006-277993 A | 10/2006 |

* cited by examiner

*Primary Examiner* — Thanh Tam Le
(74) *Attorney, Agent, or Firm* — Fujitsu Patent Center

(57) ABSTRACT

A lead terminal includes signal lead pins and GND lead pins. The signal lead pin connects one signal pattern on a flexible substrate and another signal pattern on a rigid substrate. The GND lead pin connects one GND pattern on the flexible substrate and another GND pattern in the rigid substrate. A holding member has an insulating property and holds pairs of the signal lead pins and the GND lead pins at a distance. One main part of the signal lead pin and another main part of the GND lead pin form a microstrip line structure.

8 Claims, 31 Drawing Sheets

CONNECTION TERMINAL AND TRANSMISSION LINE

CROSS-REFERENCE TO RELATED APPLICATIONS

This application is based upon and claims the benefit of priority of the prior Japanese Patent Application No. 2009-114060, filed on May 9, 2009, the entire contents of which are incorporated herein by reference.

FIELD

The embodiments discussed herein are related to a connection terminal that connects one multilayer substrate and another multilayer substrate, and a transmission line constituted by the multilayer substrates and the connection terminal.

BACKGROUND

In a high-speed transmission and reception module for optical communication, for the connection between an optical device and a circuit substrate, a flexible substrate manufactured using a transmission line has heretofore been used for correcting a displacement between the optical device and the circuit substrate.

However, the above-described high-speed transmission and reception module for optical communication is hard to realize sufficient high-frequency characteristics at a communication speed more than 10 Gbps. To cope with the above-described problem, in the high-speed transmission and reception module for optical communication having a communication speed more than 10 Gbps, a relay substrate made of ceramic has been connected between the flexible substrate and the circuit substrate as a substrate for relay.

Proposed is a connector element for high frequency transmission in which parts having surfaces facing to each other are provided on conductors for constituting a ground line and signal line of the connector element and covered with dielectric materials (see, e.g., Japanese Laid-open Patent Publication No. 06-215819).

However, the above-described relay substrate made of ceramic is expensive. Further, precision is necessary for the connection between the relay substrate and any one of the flexible substrate and the circuit substrate, and also the time for assembly is necessary. Therefore, when the high-speed transmission and reception module for optical communication is manufactured, the assembly causes an increase in cost.

In the above-described connector element for high-frequency transmission, the connection shape to the substrate of a signal line and ground line constituting the transmission line is not sufficiently taken into consideration. Therefore, even if high-frequency transmission characteristics of the connector element are preferable, loss of high-speed signal may be caused by the connection to the substrate.

SUMMARY

According to one aspect of the embodiment, there is provided a connection terminal. This connection terminal includes: a signal terminal that connects one signal line on a first multilayer substrate and another signal line on a second multilayer substrate; a ground terminal that connects one ground line on the first multilayer substrate and another ground line in the second multilayer substrate; an insulating holding medium that holds a pair of the signal terminal and the ground terminal at a distance, wherein: one terminal of the signal terminal and the ground terminal has a facing-layer connection that is connected to a surface layer facing the holding medium with respect to at least one multilayer substrate of the first and second multilayer substrates; and the other terminal of the signal terminal and the ground terminal has a non-facing connection that is connected to a layer different from the facing surface layer via a terminal insertion hole of the one multilayer substrate.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWING(S)

DESCRIPTION OF EMBODIMENT(S)

Figure 1:
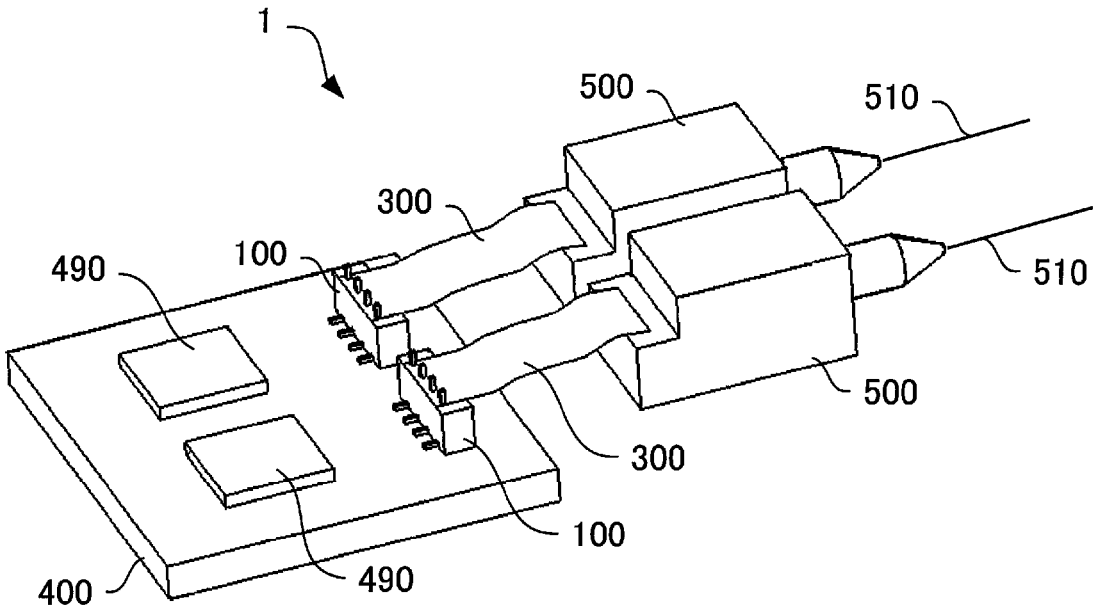
FIG. 1 illustrates an optical transmission and reception module according to a first embodiment.

Embodiments of the present invention will be described in detail below with reference to the accompanying drawings, wherein like reference numerals refer to like elements throughout.

FIG. 1 illustrates an optical transmission and reception module according to a first embodiment.

An optical transmission and reception module 1 includes lead terminals (connection terminals) 100, flexible substrates 300, a rigid substrate 400, and optical elements 500. The optical transmission and reception module 1 has transmission and reception functions of signals transmitted by light using as a transmission medium an optical fiber cable 510. The optical element 500 has a function of converting signals transmitted by light to electrical signals and vise versa. The optical element 500 converts electrical signals input from the flexible substrate 300 to light signals and transmits the converted light signals to the optical fiber cable 510. Further, the optical element 500 converts light signals input from the optical fiber cable 510 to electrical signals and transmits the converted electrical signals to the flexible substrate 300. The flexible substrate 300 connects the optical element 500 and the lead terminal 100. The flexible substrate 300 is a multilayer substrate on which a signal line and a ground line are arranged on different layers and, for example, a two-layer flexible substrate is a two-layer substrate on which a signal line is arranged on one layer and a ground line is arranged on the other layer. The lead terminal 100 connects the flexible substrate 300 and the rigid substrate 400. The rigid substrate 400 is connected to the lead terminal 100, and mounts thereon an IC (Integrated Circuit) 490 that converts high-speed signals to low-speed signals and vise versa. The IC 490 converts high-speed signals of 20 GHz or more, for example, 40 GHz to low-speed signals of 10 GHz×4 or 2.5 GHz×16. Conversely, the IC 490 converts low-speed signals of less than 20 GHz, for example, 10 GHz×4 or 2.5 GHz×16 to high-speed signals. Accordingly, high-speed signals converted from light signals to electrical signals are transmitted by high-speed electrical signals between the optical element 500 and the IC 490.

Figure 2:
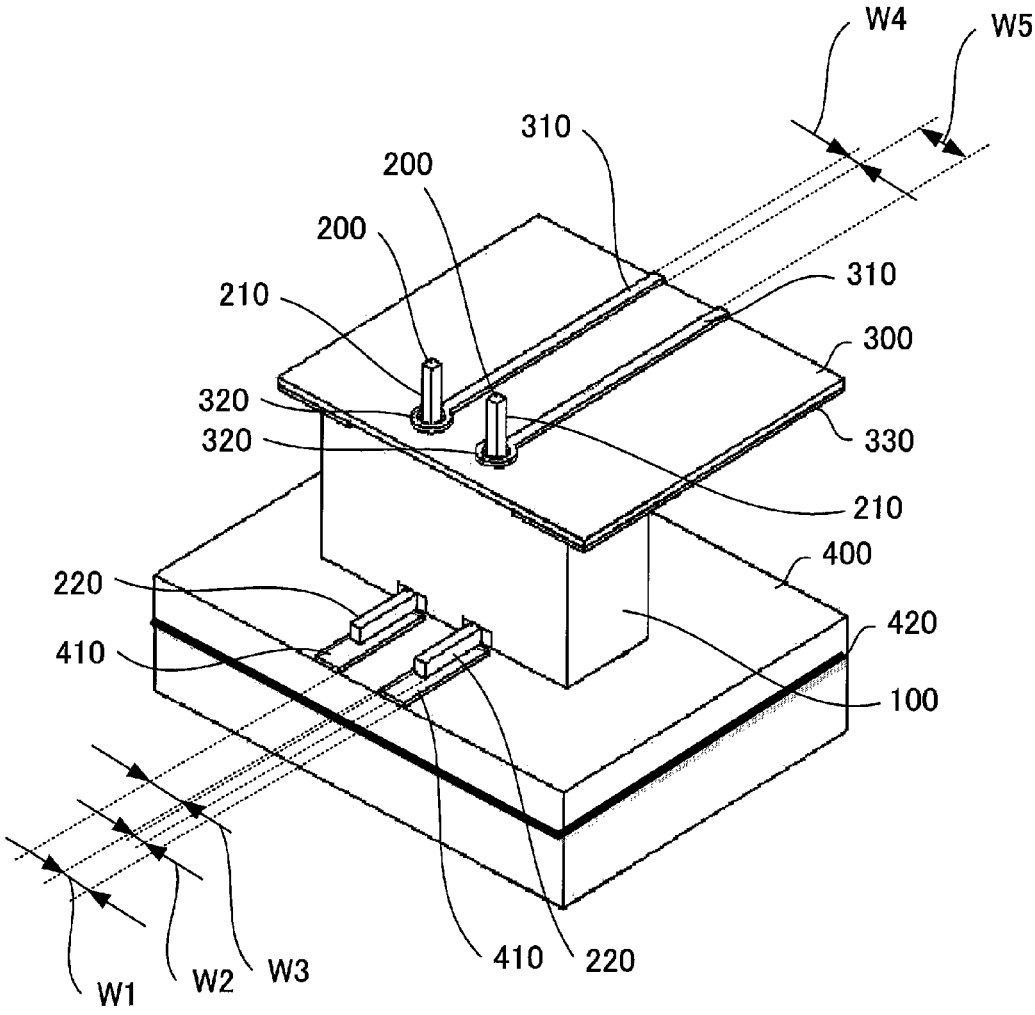
FIG. 2 is an oblique perspective view illustrating a connection state between a lead terminal and substrates according to the first embodiment.

Next, a connection state between the flexible substrate 300 and the rigid substrate 400 via the lead terminal 100 will be described. FIG. 2 is an oblique perspective view illustrating a connection state between the lead terminal 100 and substrates according to the first embodiment. To facilitate understanding of the connection state, FIG. 2 illustrates only a part of the flexible substrate 300 and the rigid substrate 400.

The lead terminal 100 includes pairs of signal lead pins (signal terminals) 200 and GND lead pins (not shown in FIG. 2) (ground terminals). The lead terminal 100 according to the present embodiment has two pairs of pins, namely, two signal lead pins and two GND lead pins. Further, the lead terminal 100 may have one pair of pins, or three pairs of pins or more. The signal lead pin 200 has connections 210 and 220 to the substrates. The connection 210 is connected to a signal pattern 310 by a connection land 320 via an insertion hole of the flexible substrate 300. The connection 220 is connected to a signal pattern 410 on the rigid substrate 400. Further, the GND lead pin is connected to a GND pattern 330 on the flexible substrate 300 and connected to a GND pattern 420 in the rigid substrate 400 via the connections (not shown).

A rigid substrate signal pattern width (width of the signal pattern 410) W1 is, for example, approximately from 250 to 300 μm. Further, a lead pin connection width (width of the connection 220) W2 is, for example, approximately from 50 to 100 μm. For example, a rigid substrate signal line gap (distance between the signal patterns 410 on the rigid substrate 400) W3 has approximately twice as wide as the thickness of the rigid substrate 400 (as a dielectric constant $\in$=approximately 3). A flexible substrate signal pattern width (width of the signal pattern 310) W4 is, for example, approximately 100 μm. Further, a flexible substrate signal line gap (distance between the signal patterns 310 on the flexible substrate 300) W5 is, for example, approximately 400 μm.

As described above, since widths of the signal patterns 310 and 410 and the connections 210 and 220 are several hundred μm at most, a connection with the precision of approximately ±50 μm is needed. A connection with low precision deteriorates transmission characteristics of high-speed signals.

Figure 3:
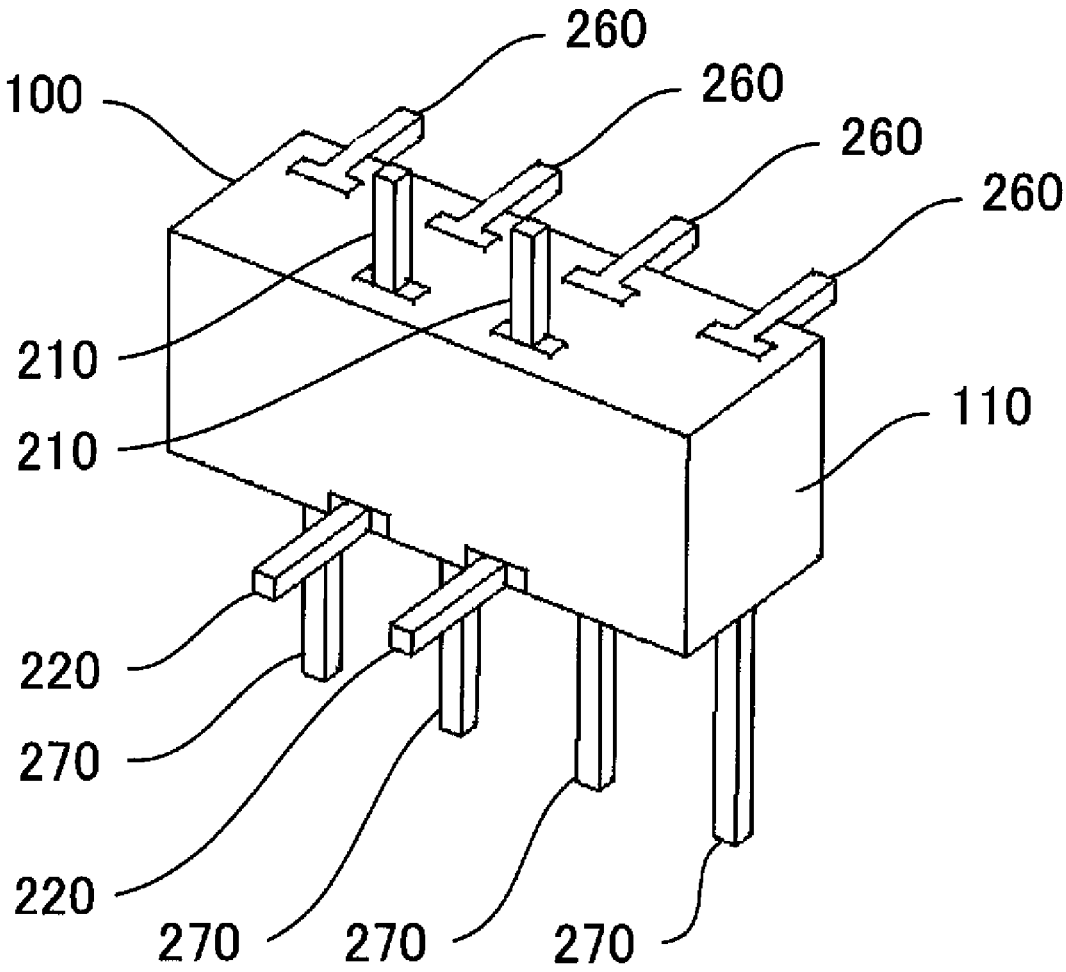
FIG. 3 is an oblique perspective view illustrating an appearance of the lead terminal according to the first embodiment.
Figure 4:
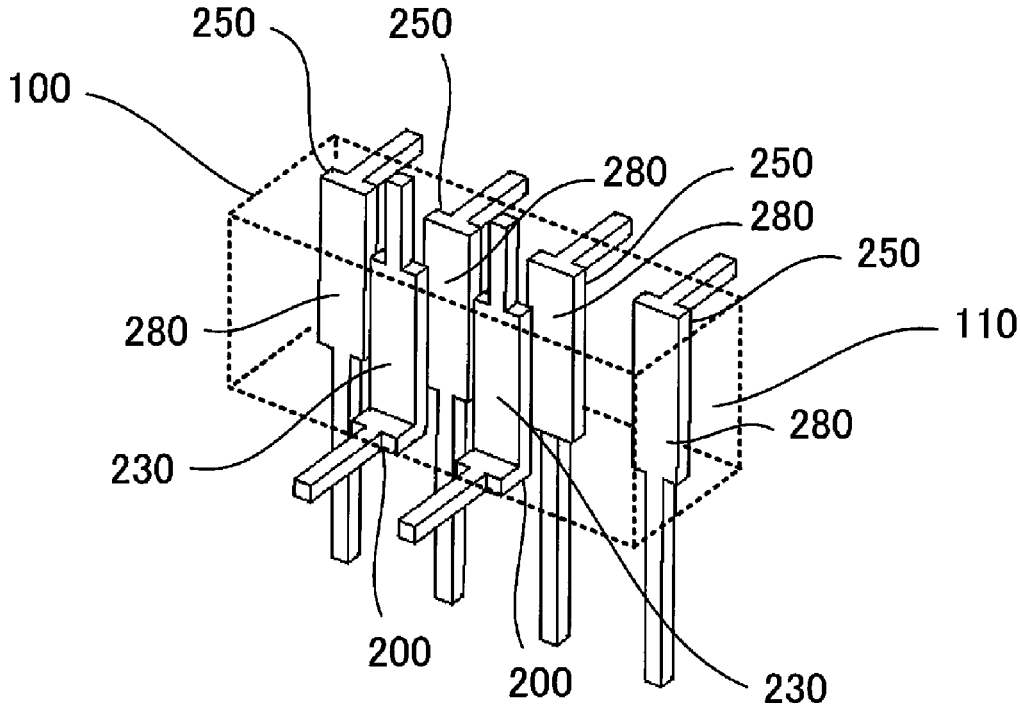
FIG. 4 is an oblique perspective view illustrating an internal structure of the lead terminal according to the first embodiment.

Next, an appearance and internal structure of the lead terminal 100 will be described with reference to FIGS. 3 and 4. FIG. 3 is an oblique perspective view illustrating an appearance of the lead terminal 100 according to the first embodiment. FIG. 4 is an oblique perspective view illustrating an internal structure of the lead terminal 100 according to the first embodiment.

The lead terminal 100 includes the two signal lead pins 200, the two GND lead pins 250 that are respectively paired to the two signal lead pins 200, and the two GND lead pins 250 that are not paired to the two signal lead pins 200. The lead terminal 100 embeds main parts 230 of the two signal lead pins 200 and main parts 280 of the four GND lead pins 250 in a holding member 110, and holds the signal lead pins 200 and the GND lead pins 250. The holding member 110 has an appearance of rectangular parallelepiped and the connections 210 of the two signal lead pins 200 are protruded from the upper surface (contact surface with the flexible substrate 300) of the holding member 110. Further, connections 260 of the four GND lead pins 250 are protruded from the back side (the side facing away from the lead terminal 100, as can be seen from the IC 490 in FIG. 1) of the holding member 110, with a connection surface thereof facing toward the flexible substrate 300 from the upper surface of the holding member 110.

Further, connections 270 of the four GND lead pins 250 are protruded from a lower surface (contact surface with the rigid substrate 400) of the holding member 110. While facing a connection surface toward the rigid substrate 400 from a lower surface of the holding member 110, the connections 220 of the two signal lead pins 200 are protruded from a front face (the face facing the IC 490 in FIG. 1) of the holding member 110.

The main parts 230 of the two signal lead pins 200 faces, at a constant distance, the main parts 280 of the two GND lead pins 250 that are paired to the two signal lead pins 200. Since the space between the facing main parts 230 and 280 is filled with the holding member 110, an impedance of a microstrip line formed in the lead terminal 100 is determined using as one of parameters a dielectric constant of the holding member 110. The holding member 110 is made of, for example, resin and includes a liquid crystal polymer more specifically. For example, the liquid crystal polymer with a dielectric constant of 3 has the facility for designing an impedance of a microstrip line. Further, the liquid crystal polymer can be molded and therefore, has the facility for manufacturing the lead terminal 100.

The holding member 110 holds one row of the two signal lead pins 200 and another row of the four GND lead pins 250 at a constant distance.

In addition, the main parts 280 of the four GND lead pins 250 in the row composing one row of the lead pins can be grasped to form one ground plane (GND plane). Accordingly, it can be grasped that a plurality of the main parts 280 form one ground plane and the one signal lead pin 200 forms one pair relative to the one ground plane.

Figure 5:
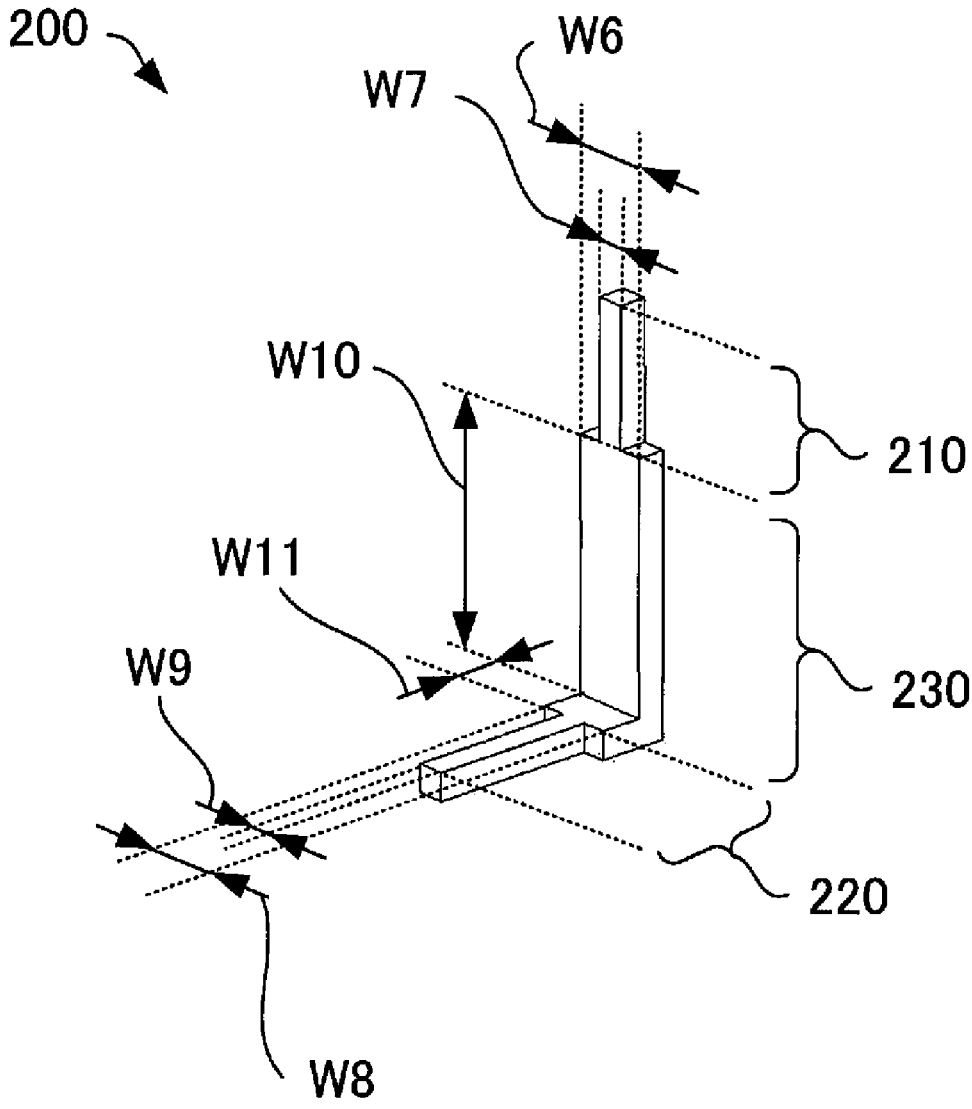
FIG. 5 is an oblique perspective view illustrating an appearance of a signal lead pin according to the first embodiment.

Next, a shape of the signal lead pin 200 will be described in detail. FIG. 5 is an oblique perspective view illustrating an appearance of the signal lead pin according to the first embodiment.

The signal lead pin 200 includes the main part 230, the connection 210, and the connection 220. The signal lead pin 200 is made of, for example, a conductor such as metal, and its material specifically includes copper, plated copper, and brass. The connection 210 has a flexible substrate side main part width (width of the main part 230 on the flexible substrate 300 side) W6 at the upper surface of the holding member 110, and is protruded from the upper surface of the holding member 110 with a flexible substrate side connection width (width of the connection 210 on the flexible substrate 300 side) W7. The connection 220 has a rigid substrate side main part width (width of the main part 230 on the rigid substrate 400 side) W8 at the front face of the holding member 110, and is protruded from the front face of the holding member 110 with a rigid substrate side connection width (width of the connection 220 on the rigid substrate 400 side) W9. The main part 230 bends at a right angle on the way, and a length on the connection 210 side is given a return length W10 and a length on the connection 220 side is given a return length W11, and further, the return lengths W10 and W11 are set to have different values from each other. In the main part 230, a GND lead pin facing part with a length as long as the return length W10 forms a microstrip line with the GND lead pin 250 to be paired. In the main part 230, a rigid substrate facing part with a length as much as the return length W11 forms a microstrip line with the GND pattern (GND layer) 420 in the rigid substrate 400. In addition, the return lengths W10 and W11 may be set to become equal to each other.

In the present embodiment, the flexible substrate side main part width W6 and the rigid substrate side main part width W8 are equal to each other, and may be different from each other according to a signal pattern width and a distance between the signal patterns of the flexible substrate 300 or the rigid substrate 400.

Similarly, in the present embodiment, the flexible substrate side connection width W7 and the rigid substrate side connection width W9 are equal to each other, and may be different from each other according to a signal pattern width and a distance between the signal patterns of the flexible substrate 300 or the rigid substrate 400.

Figure 6:
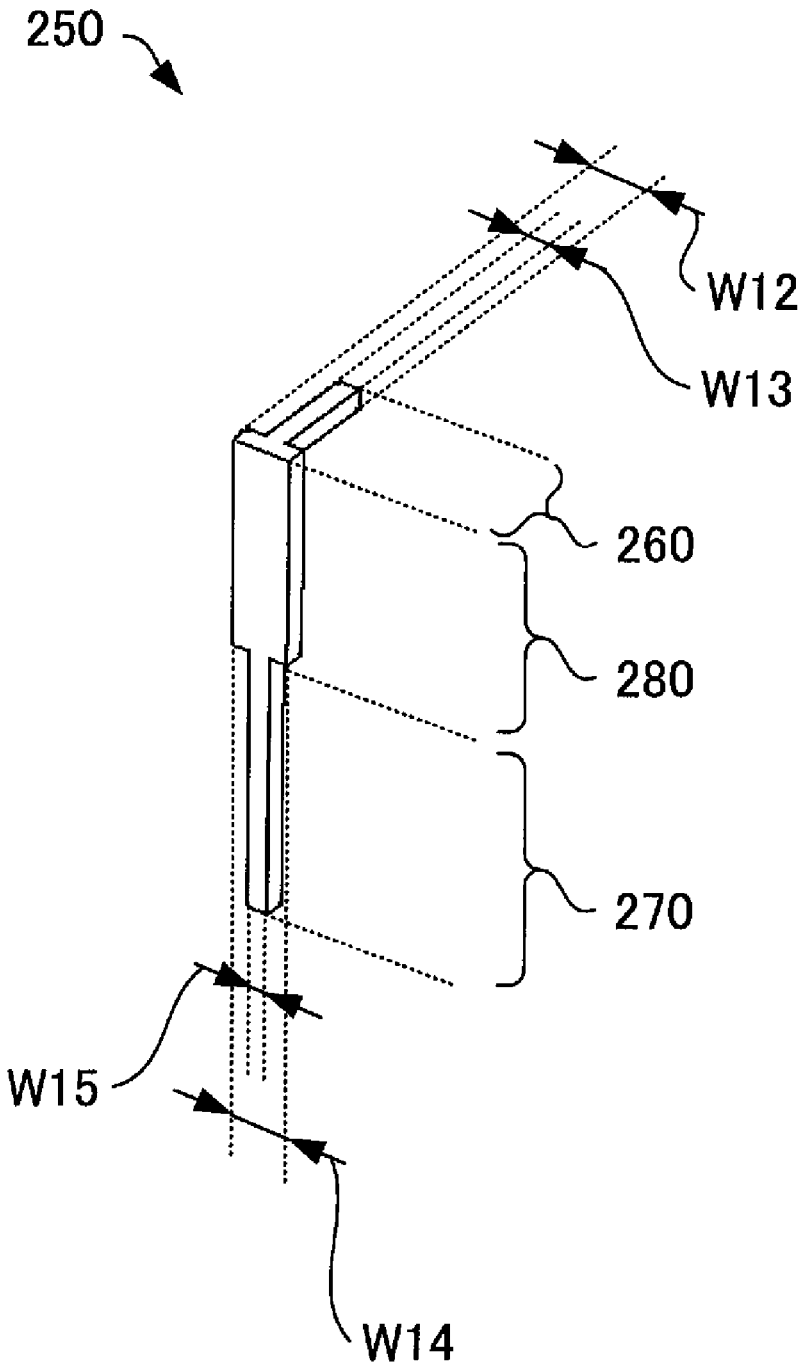
FIG. 6 is an oblique perspective view illustrating an appearance of a GND lead pin according to the first embodiment.

Next, a shape of the GND lead pin 250 will be described in detail. FIG. 6 is an oblique perspective view illustrating an appearance of the GND lead pin according to the first embodiment.

The GND lead pin 250 has the main part 280 and connections 260 and 270. The GND lead pin 250 is made of, for example, a conductor such as metal, and its material specifically includes copper, plated copper, and brass.

The connection 260 has a flexible substrate side main part width (width of the main part 280 on the flexible substrate 300 side) W12 at an upper surface of the holding member 110, and bends at a right angle along an upper surface of the holding member 110. Further, the connection 260 is protruded from the back side of the holding member 110 with a flexible substrate side connection width (width of the connection 260 on the flexible substrate 300 side) W13. Similarly, the connection 270 has a rigid substrate side main part width (width of the main part 280 on the rigid substrate 400 side) W14 at a lower surface of the holding member 110, and is protruded from a lower surface of the holding member 110 with a rigid substrate side connection width (width of the connection 270 on the rigid substrate 400 side) W15.

In the present embodiment, the flexible substrate side main part width W12 and the rigid substrate side main part width W14 are equal to each other, and may be different from each other according to a signal pattern width and a distance between the signal patterns of the flexible substrate 300 or the rigid substrate 400.

Similarly, in the present embodiment, the flexible substrate side connection width W13 and the rigid substrate side connection width W15 are equal to each other, and may be different from each other according to a signal pattern width and a distance between the signal patterns of the flexible substrate 300 or the rigid substrate 400.

Figure 7:
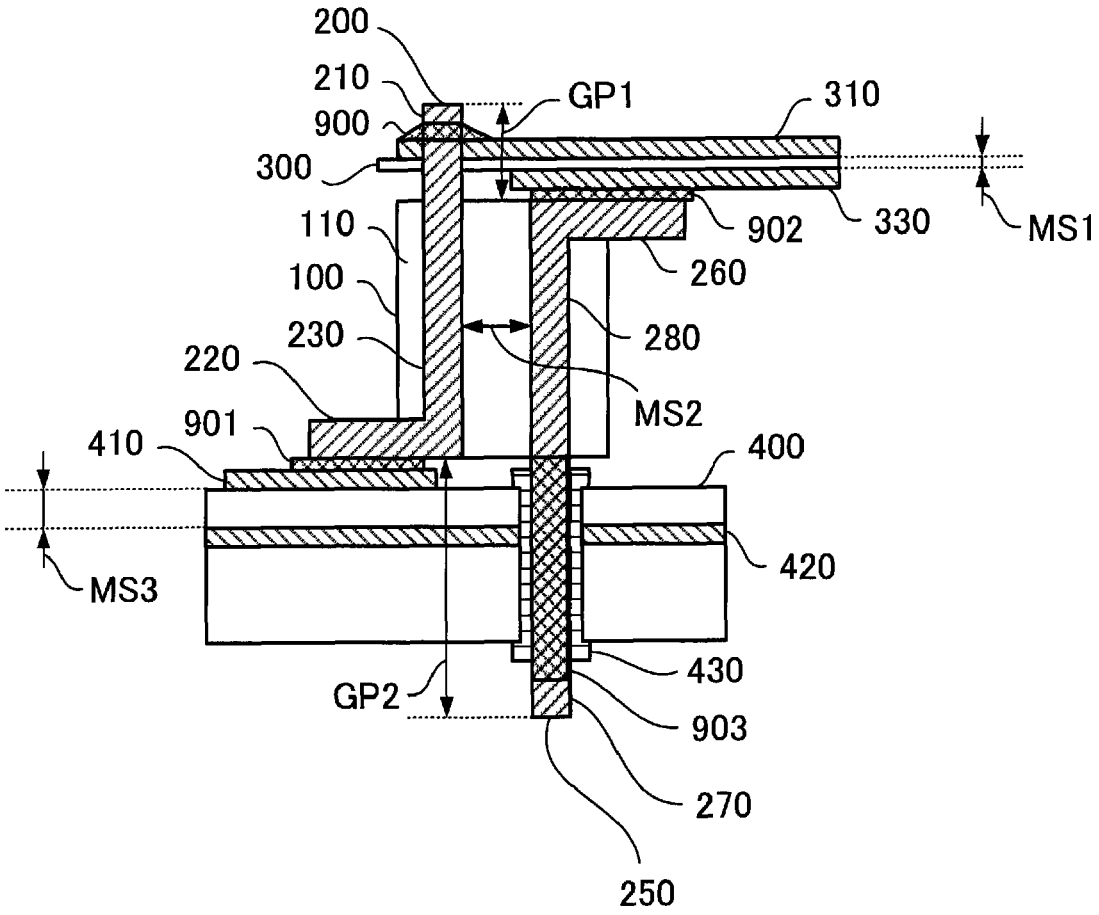
FIG. 7 is a schematic cross sectional view illustrating a connection state between the lead terminal and substrates according to the first embodiment.
Figure 8:
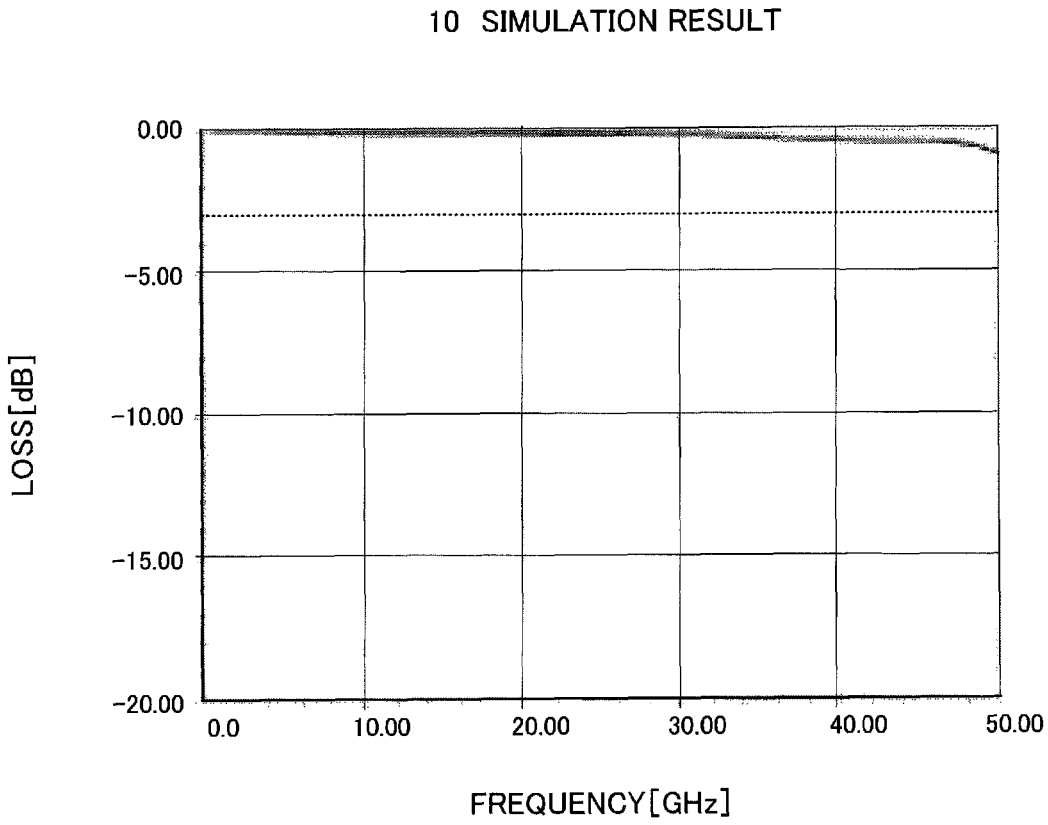
FIG. 8 is a simulation result illustrating transmission characteristics of a signal line according to the first embodiment.

Next, a transmission line formed by the lead terminal 100 connecting the flexible substrate 300 and the rigid substrate 400 will be described with reference to FIGS. 7 and 8. FIG. 7 is a schematic cross sectional view illustrating a connection state between the lead terminal and substrates according to the first embodiment. FIG. 8 is a simulation result illustrating transmission characteristics of the signal line according to the first embodiment.

The flexible substrate 300 includes the signal pattern 310 on the upper side and the GND pattern 330 on the lower side, with a base material interposed in between. The signal pattern 310 and the GND pattern 330 form a microstrip structure MS1.

The rigid substrate 400 includes the signal pattern 410 on the upper side and the GND pattern 420 on the lower side, with a base material interposed in between. The signal pattern 410 and the GND pattern 420 form a microstrip structure MS3.

The lead terminal 100 includes the main parts 230 of the signal lead pins 200 on one side and the main parts 280 of the GND lead pins 250 on the other side, with the holding member 110 interposed in between. The main parts 230 of the signal lead pins 200 and the main parts 280 of the GND lead pins 250 form a microstrip structure MS2.

As described above, the transmission line according to the present embodiment serially has microstrip structures, specifically, the microstrip structure MS1 in the flexible substrate 300, the microstrip structure MS2 in the lead terminal 100, and the microstrip structure MS3 in the rigid substrate 400. In the above-described transmission line, a simulation result 10 (FIG. 8) in which loss of transmission signals is reduced and in which loss of high-speed signals up to 50 GHz is less than −3 dB is obtained. This simulation result is obtained only by a simulation method taking into consideration also a three-dimensional structure, and cannot be analogized by a formula (1) as a calculating formula of the transmission line. Much the same is true on the after-mentioned simulation result.

For the purpose of connecting the lead terminal 100 and the flexible substrate 300, the signal lead pin 200 is inserted into a through-hole of the flexible substrate 300 to protrude the connection 210 from an upper surface of the flexible substrate 300. Then, the signal lead pin 200 and the flexible substrate 300 are fixed by solder 900. As described above, the signal lead pin 200 is inserted into a through-hole of the flexible substrate 300, thereby performing positioning of the lead terminal 100 and the flexible substrate 300. Therefore, the lead terminal 100 and the flexible substrate 300 can be connected to each other with high precision, and transmission characteristics of high-speed signals are prevented from being deteriorated. Further, high-frequency characteristics of the transmission line may be preferable when the tip of the signal lead pin 200 protruded from the signal pattern 310 is made short.

When using a plurality of the signal lead pins 200, the positioning of the lead terminal 100 and the flexible substrate 300 can be performed more definitely.

For the purpose of connecting the lead terminal 100 and the flexible substrate 300, the GND lead pin 250 is connected so as to mount the flexible substrate 300 on the connection 260. Then, the GND lead pin 250 and the flexible substrate 300 are fixed by solder 902. As described above, the signal lead pin 200 and the GND lead pin 250 have a gap GP1 in the height direction, and the gap GP1 is set to be larger than a distance between layers of the signal pattern 310 and GND pattern 330 on the flexible substrate 300. The above-described gap GP1 makes a contribution to the realization of the transmission line having serial microstrip structures of the microstrip structures MS1 and MS2 in the flexible substrate 300 and the lead terminal 100.

For the purpose of connecting the lead terminal 100 and the rigid substrate 400, the GND lead pin 250 is inserted into a via hole 430 of the rigid substrate 400 to protrude the connection 270 from a lower surface of the rigid substrate 400. Then, the GND lead pin 250 and the rigid substrate 400 are fixed by solder 903. As described above, the GND lead pin 250 is inserted into a through-hole of the rigid substrate 400, thereby performing the positioning of the lead terminal 100 and the rigid substrate 400. Therefore, the lead terminal 100 and the rigid substrate 400 can be connected to each other with high precision, and the transmission characteristics of the high-speed signals are prevented from being deteriorated.

When using a plurality of the GND lead pins, the positioning of the lead terminal 100 and the rigid substrate 400 can be performed more definitely.

For the purpose of connecting the lead terminal 100 and the rigid substrate 400, the signal lead pin 200 is connected so as to mount the connection 220 on the rigid substrate 400. Then, the signal lead pin 200 and the rigid substrate 400 are fixed by the solder 901. As described above, the signal lead pin 200 and the GND lead pin 250 have a gap GP2 in the height direction, and the gap GP2 is set to be larger than a distance between layers of the signal pattern 410 and GND pattern 420 on the rigid substrate 400. The above-described gap GP2 makes a contribution to the realization of the transmission line having serial microstrip structures of the microstrip structures MS3 and MS2 in the rigid substrate 400 and the lead terminal 100.

Figure 9:
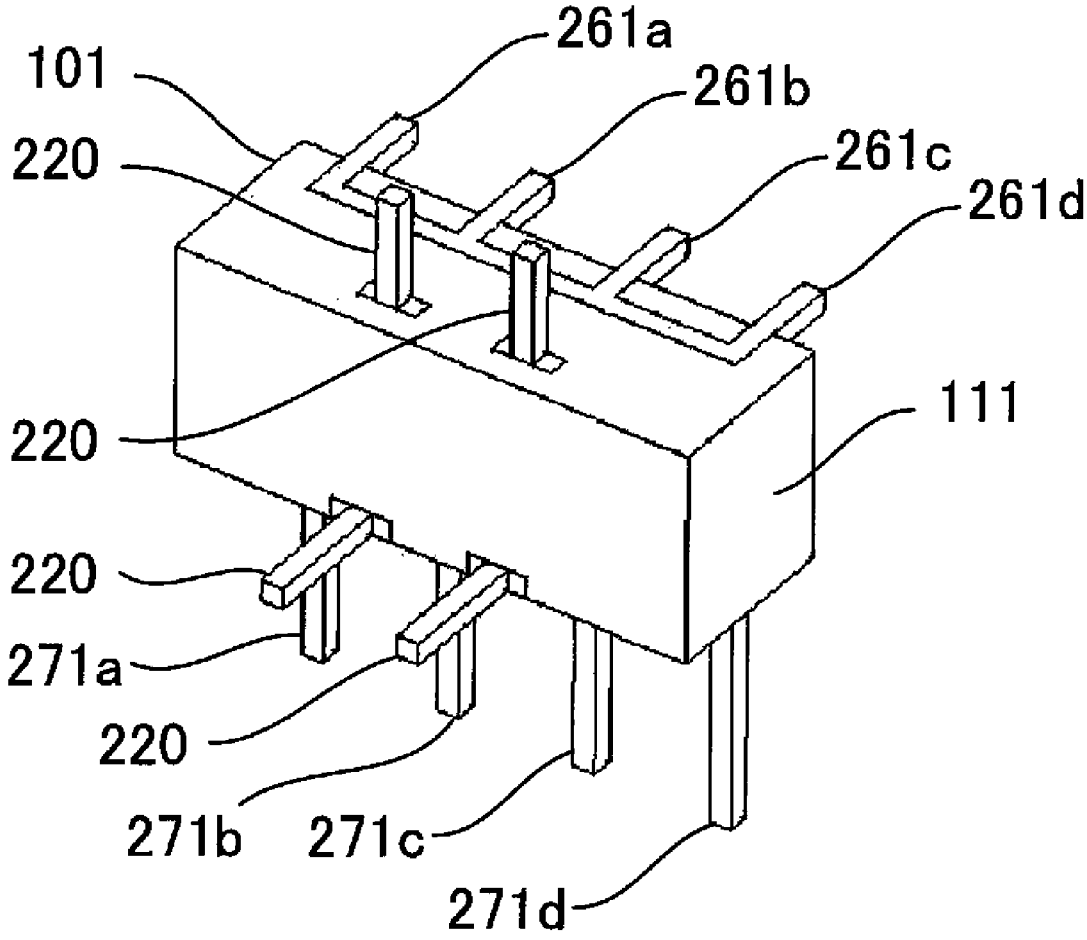
FIG. 9 is an oblique perspective view illustrating an appearance of the lead terminal according to a second embodiment.
Figure 10:
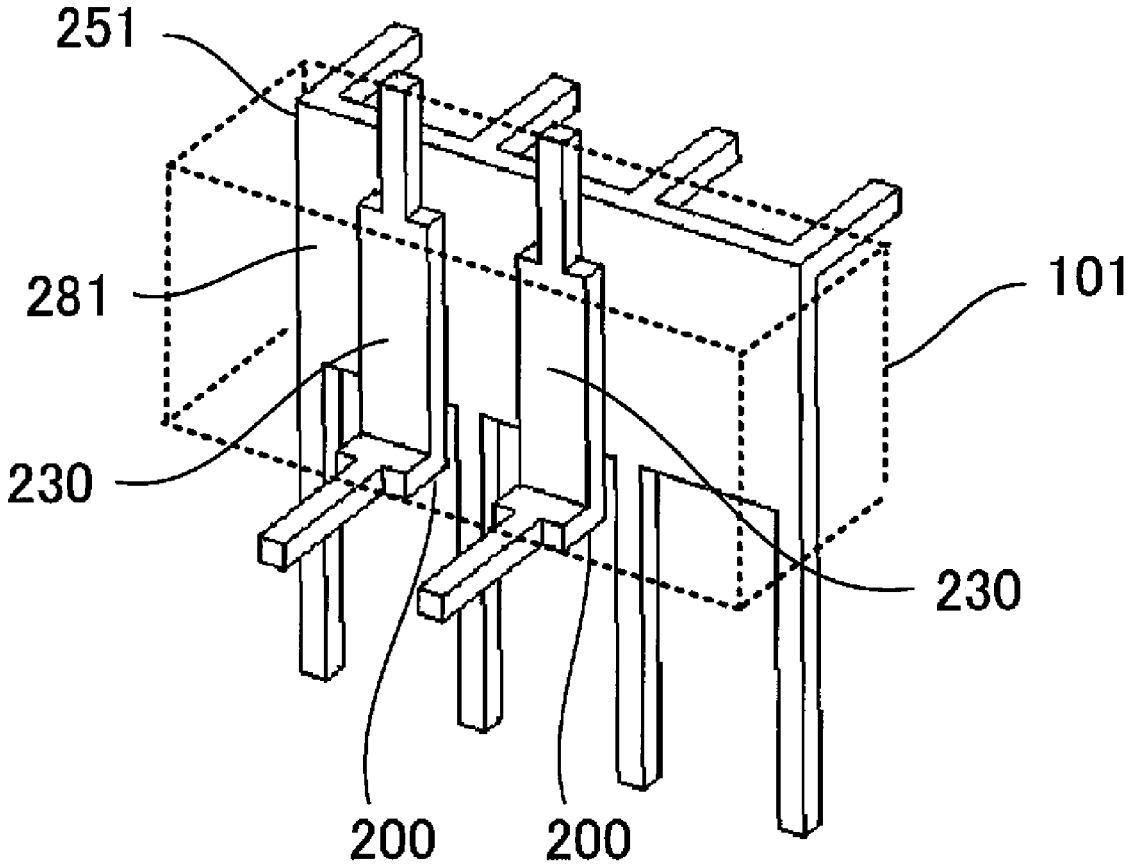
FIG. 10 is an oblique perspective view illustrating an internal structure of the lead terminal according to the second embodiment.

Next, a second embodiment will be described. An appearance and internal structure of the lead terminal will be described with reference to FIGS. 9 and 10. FIG. 9 is an oblique perspective view illustrating an appearance of the lead terminal according to the second embodiment. FIG. 10 is an oblique perspective view illustrating an internal structure of the lead terminal according to the second embodiment.

The lead terminal 101 includes the two signal lead pins 200 and a GND lead pin 251 that is paired to the two signal lead pins 200. The GND lead pin 251 has the same connection as those of the four GND lead pins 250 (refer to the first embodiment) and differs from those of the first embodiment in that the main parts are integrated into one component. Due to this integration of the main part 281, the GND lead pin 251 obtains a large ground region. The lead terminal 101 embeds the main parts 230 of the two signal lead pins 200 and the main part 281 of the GND lead pin 251 in the holding member 111, and holds the signal lead pins 200 and the GND lead pin 251. The holding member 111 has an appearance of rectangular parallelepiped, and the connections 210 of the two signal lead pins 200 are protruded from an upper surface (contact surface with the flexible substrate 300) of the holding member 111. Four connections 261*a*, 261*b*, 261*c*, and 261*d* of the GND lead pin 251 are protruded from the back side (the side facing away from the lead terminal 101 in FIG. 1) of the holding member 111 while facing a connection surface toward the flexible substrate 300 from an upper surface of the holding member 111.

Four connections 271*a*, 271*b*, 271*c*, and 271*d* of the GND lead pin 251 are protruded from a lower surface (contact surface with the rigid substrate 400) of the holding member 111. Further, the connections 220 of the two signal lead pins 200 are protruded from a front surface (the surface facing the IC 490 in FIG. 1) of the holding member 111 while facing the connection surface toward the rigid substrate 400 from a lower surface of the holding member 111.

The main parts 230 of the two signal lead pins 200 each face the main part 281 of the GND lead pin 251 to be paired at a constant distance. Since the space between the facing main parts 230 and 281 is filled with the holding member 111, an impedance of a microstrip line formed in the lead terminal 101 is determined using as one of parameters a dielectric constant of the holding member 111. The holding member 111 is made of, for example, resin, and includes a liquid crystal polymer (e.g., a dielectric constant of 3) more specifically. It is designed that the impedance of connections matches the impedance of a substrate to be connected.

The holding member 111 holds one row of the lead pins formed by the two signal lead pins 200 and another row of the lead pin formed by the connections 261*a*, 261*b*, 261*c*, and 261*d* (or the connections 271*a*, 271*b*, 271*c*, and 271*d*) of the GND lead pin 251 at a constant distance.

In addition, the GND lead pin 251 has a pair with a plurality of the signal lead pins 200 due to the integration of the main part 281.

In other words, the GND lead pin 251 has pairs with ground planes formed by a plurality of the signal lead pins 200 due to the integration of the main part 281.

Figure 11:
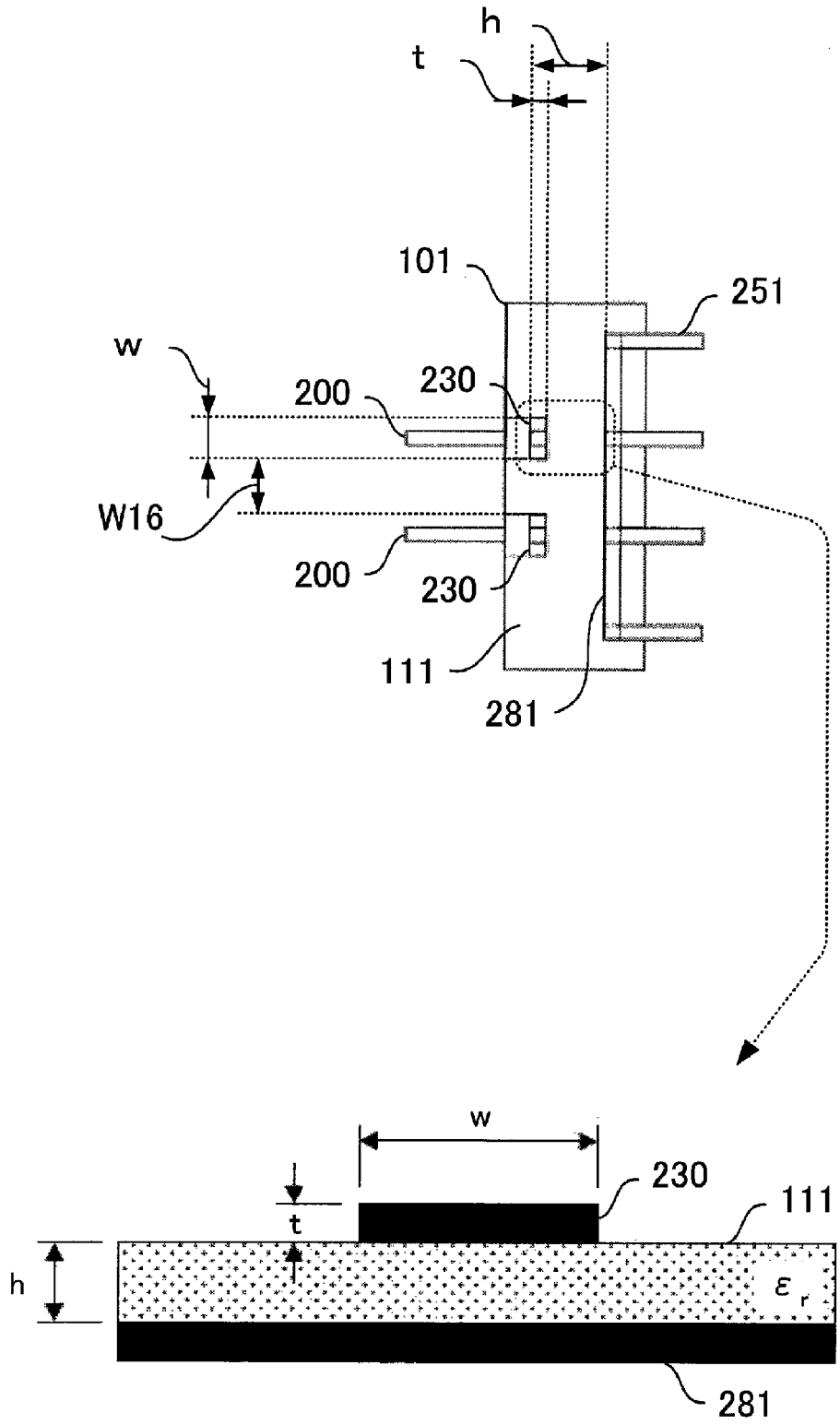
FIG. 11 illustrates a microstrip line according to the second embodiment.

Next, calculation of impedance of a microstrip line will be described. FIG. 11 illustrates a microstrip line according to the second embodiment.

Impedance of the microstrip line formed by the main parts 230 of the signal lead pins 200 and the main part 281 of the GND lead pin 251 with the holding member 111 interposed in between can be calculated by the formula (1). FIG. 11 illustrates a state of the lead terminal 101 seen from the connection direction with the flexible substrate 300, and is a schematic view of a region for forming a microstrip line.

formula (1)

$$Z_0 = \frac{60}{\sqrt{0.475_{\varepsilon_r} + 0.67}} \ln\left(\frac{5.98h}{0.8w + t}\right) \quad (1)$$

A parameter w in the formula (1) denotes a width (signal line width) of the main part 230 of the signal lead pin 200. A parameter h in the formula (1) denotes a distance (dielectric material thickness) between the main part 230 of the signal lead pin 200 and the main part 281 of the GND lead pin 251 facing the main part 230 of the signal lead pin 200. A parameter t in the formula (1) denotes a thickness (signal line thickness) of the main part 230 of the signal lead pin 200. A parameter $\in_r$ in the formula (1) denotes a dielectric constant of the holding member 111.

When inverse voltages are given to the two approximated signal lead pins 200, the present embodiment can provide a differential transmission line for forming a differential microstrip line. In this case, a signal lead pin main part distance W16 is preferably narrowed down in the range where a restriction in mounting is not received for the connection to the substrate.

A thickness of the main part 230 of the signal lead pin 200 according to the present embodiment is, for example, approximately 100 μm.

Figure 12:
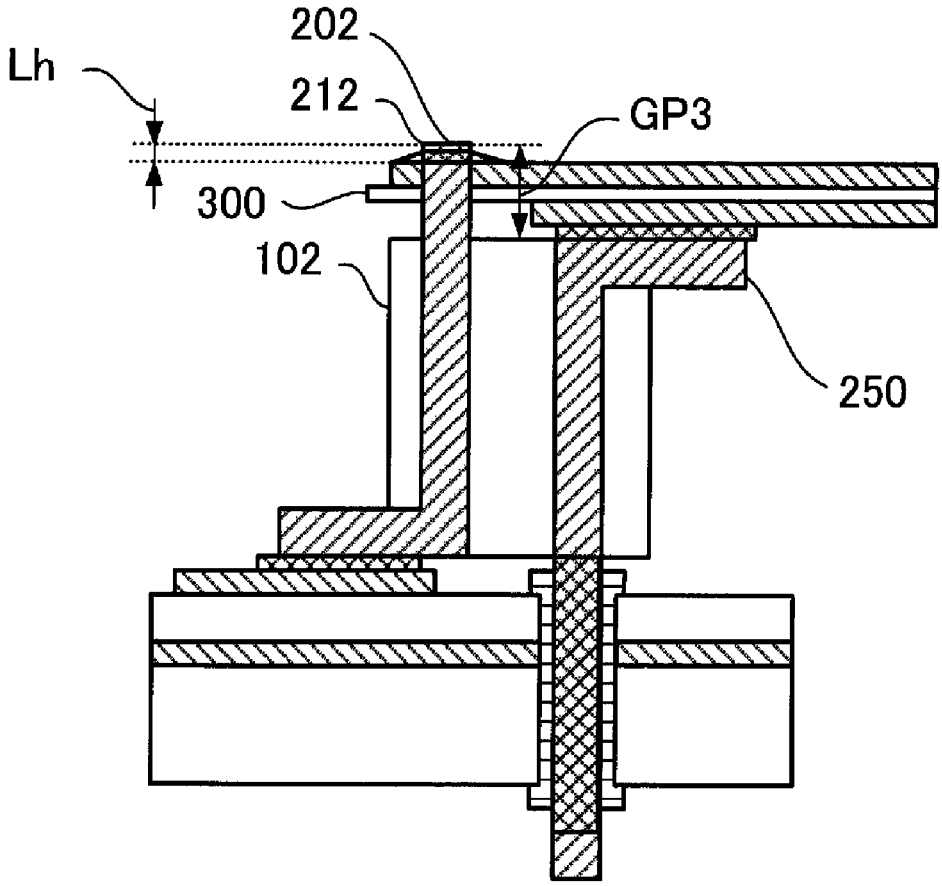
FIG. 12 is a schematic cross sectional view illustrating a connection state between the lead terminal and substrates according to a third embodiment.
Figure 13:
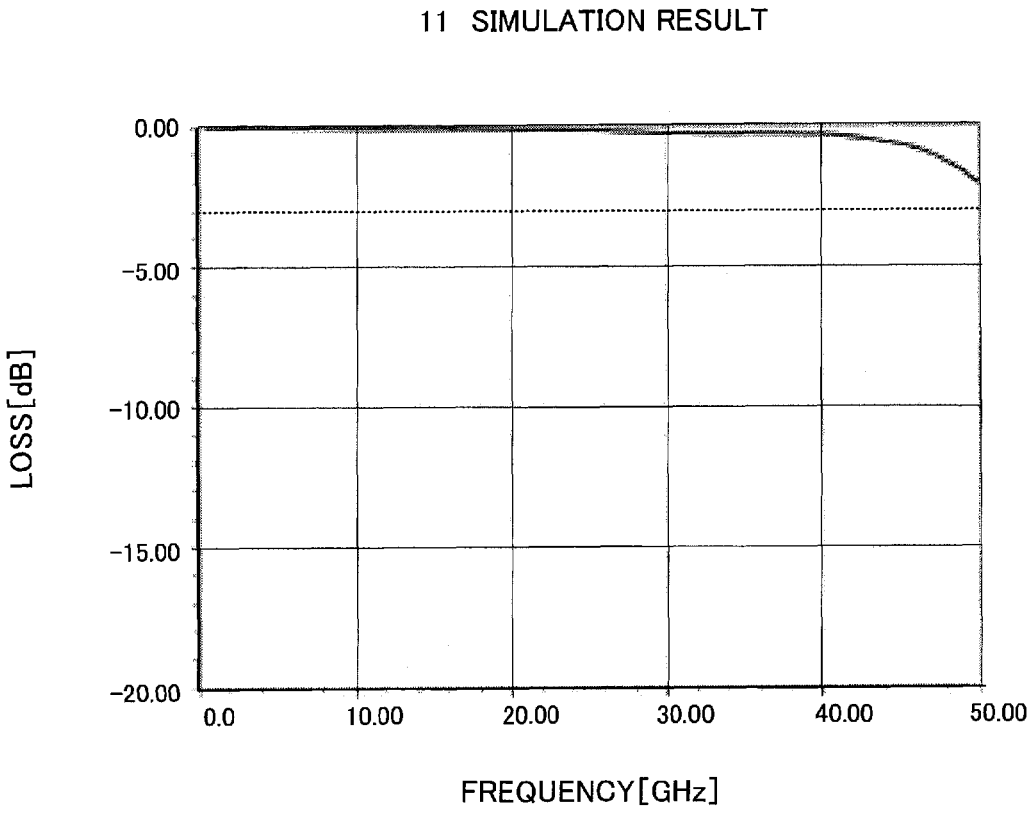
FIG. 13 is a simulation result illustrating transmission characteristics of the signal line according to the third embodiment.
Figure 14:
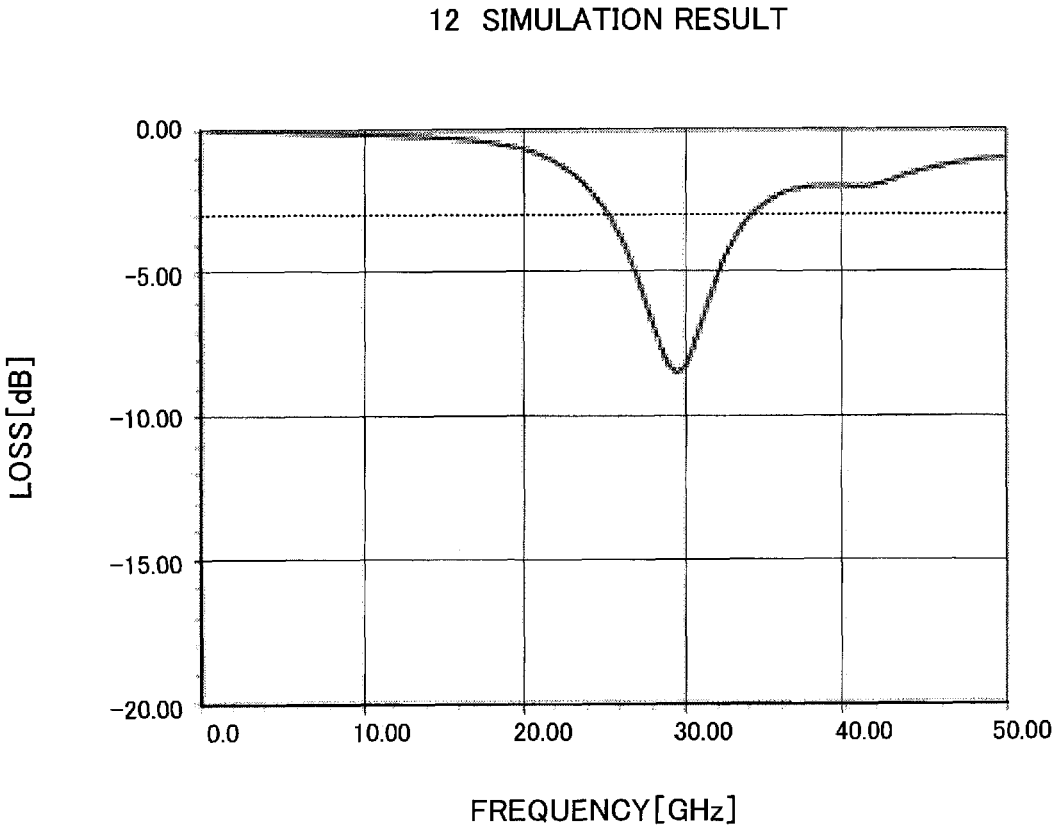
FIG. 14 is a simulation result illustrating transmission characteristics of the signal line according to the third embodiment.

Next, a third embodiment will be described. Here, an influence of the lead pin protruded from the substrate will be described with reference to FIGS. 12, 13, and 14. FIG. 12 is a schematic cross sectional view illustrating a connection state between the lead terminal and substrates according to the third embodiment. FIGS. 13 and 14 are simulation results illustrating transmission characteristics of signal lines according to the third embodiment.

The lead terminal 102 according to the third embodiment differs from the first embodiment in that a gap GP3 in the height direction between the signal lead pin 202 and the GND lead pin 250 is set to be smaller than the gap GP1 of the lead terminal 100 (refer to the first embodiment).

For the purpose of connecting the lead terminal 102 and the flexible substrate 300, the connection 212 of the signal lead pin 202 is inserted into a through-hole of the flexible substrate 300 and protruded from the upper surface of the flexible substrate 300. At this time, the protruding amount (lead pin protruding height) Lh is suppressed as compared with that of the lead terminal 100. Specifically, the protruding amount Lh may be preferably 2.0 mm or less, and more preferably approximately 0.7 mm. This makes it possible to attain both of the prevention of deterioration in the transmission characteristics of high-speed signals and the positioning of the lead terminal 102 and the flexible substrate 300.

The simulation result 11 illustrates transmission characteristics of signal lines in the case where the protruding amount Lh is 0.7 mm. Loss of the high-speed signals up to 50 GHz is reduced in the above-described transmission line. Meanwhile, the simulation result 12 illustrates transmission characteristics of signal lines in the case where the protruding amount Lh is 2.0 mm. In the above-described transmission line, loss of the high-speed signals at about 30 GHz is approximately −9 dB; however, loss of the high-speed signals at a wide frequency band up to 25 GHz is reduced.

Figure 15:
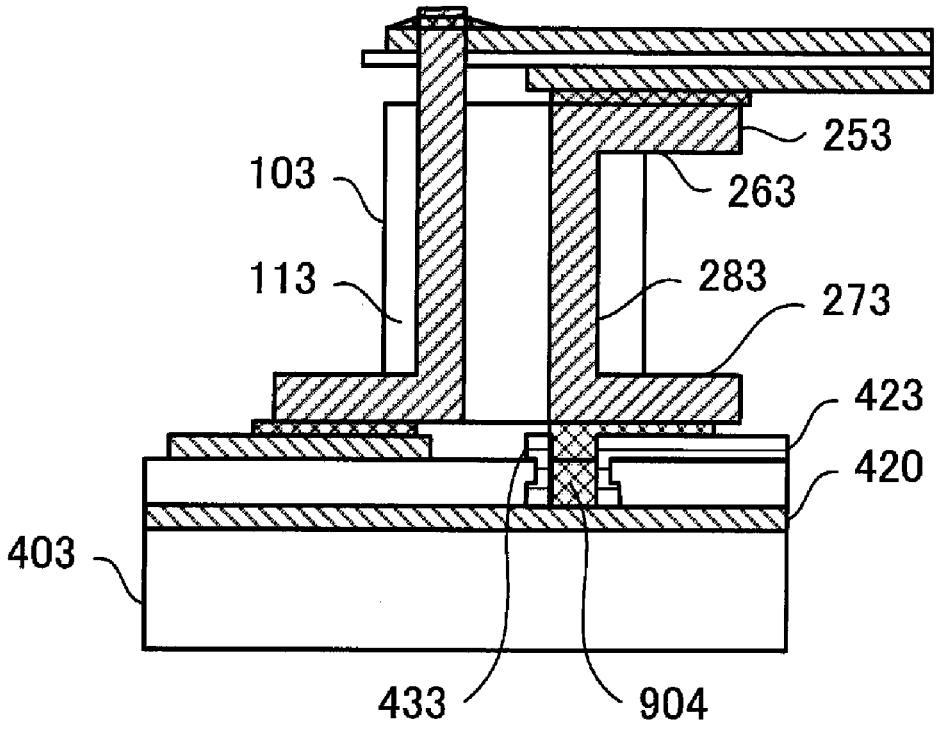
FIG. 15 is a schematic cross sectional view illustrating a connection state between the lead terminal and substrates according to a fourth embodiment.
Figure 16:
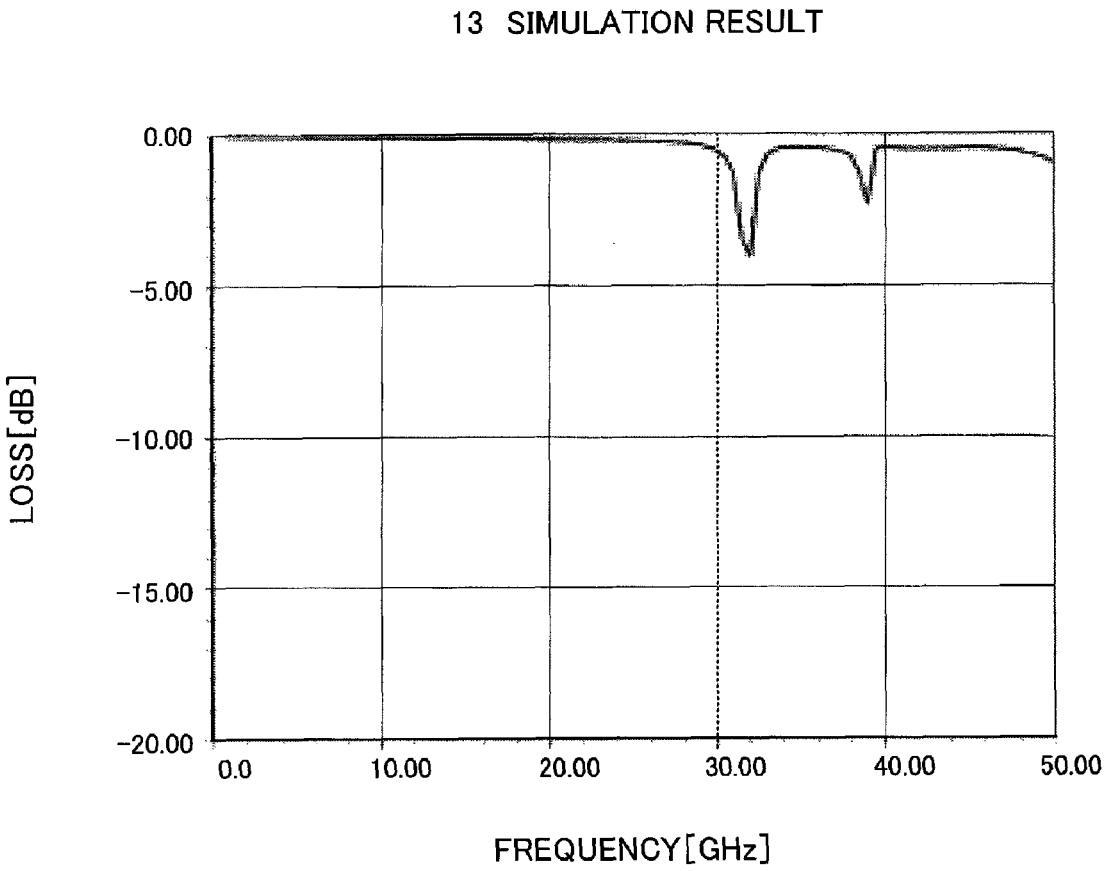
FIG. 16 is a simulation result illustrating transmission characteristics of the signal line according to the fourth embodiment.

Next, a fourth embodiment will be described. Here, an influence of a via hole provided in the rigid substrate will be described with reference to FIGS. 15 and 16. FIG. 15 is a schematic cross sectional view illustrating a connection state between the lead terminal and substrates according to the fourth embodiment. FIG. 16 is a simulation result illustrating transmission characteristics of signal lines according to the fourth embodiment.

The lead terminal 103 according to the fourth embodiment differs from the lead terminal 100 according to the first embodiment in the following. That is, the GND lead pin 253 of the lead terminal 103 is surface-mounted on the rigid substrate 403 and the GND lead pin 250 of the lead terminal 100 is inserted and mounted on the rigid substrate 400.

The connection 273 of the GND lead pin 253 bends at a right angle along a lower surface of the holding member 113. Accordingly, the GND lead pin 253 is a U-shaped lead pin that bends at a right angle between the connection 263 and the main part 283 and bends at a right angle between the connection 273 and the main part 283. The above-described GND lead pin 253 is connected such that the connection 273 is mounted on the rigid substrate 403 to connect the lead terminal 103 and the rigid substrate 403. Specifically, cream solder 904 is applied to the rigid substrate 403 and the lead terminal 103 is mounted by an automatic mounting machine to be reflow-soldered onto the rigid substrate 403. The rigid substrate 403 enables, when connecting the GND patterns 420 and 423 via the via hole 433, the lead terminal 103 to become an SMD (SMD: Surface Mount Device).

As described above, when the lead terminal 103 is an SMD, the need for insertion of the GND lead pin 253 into the rigid substrate 403 is eliminated for performing the positioning for the connection between the lead terminal 103 and the rigid substrate 403. Even if the GND lead pin 253 is not inserted into the rigid substrate 403, the lead terminal 103 and the rigid substrate 403 can be connected to each other with high precision, thereby preventing deterioration in the transmission characteristics of the high-speed signals.

In the above-described transmission line, the simulation result 13 (FIG. 16) in which loss of the transmission signal is reduced and in which loss of high-speed signals up to 30 GHz is less than −3 dB is obtained.

Figure 17:
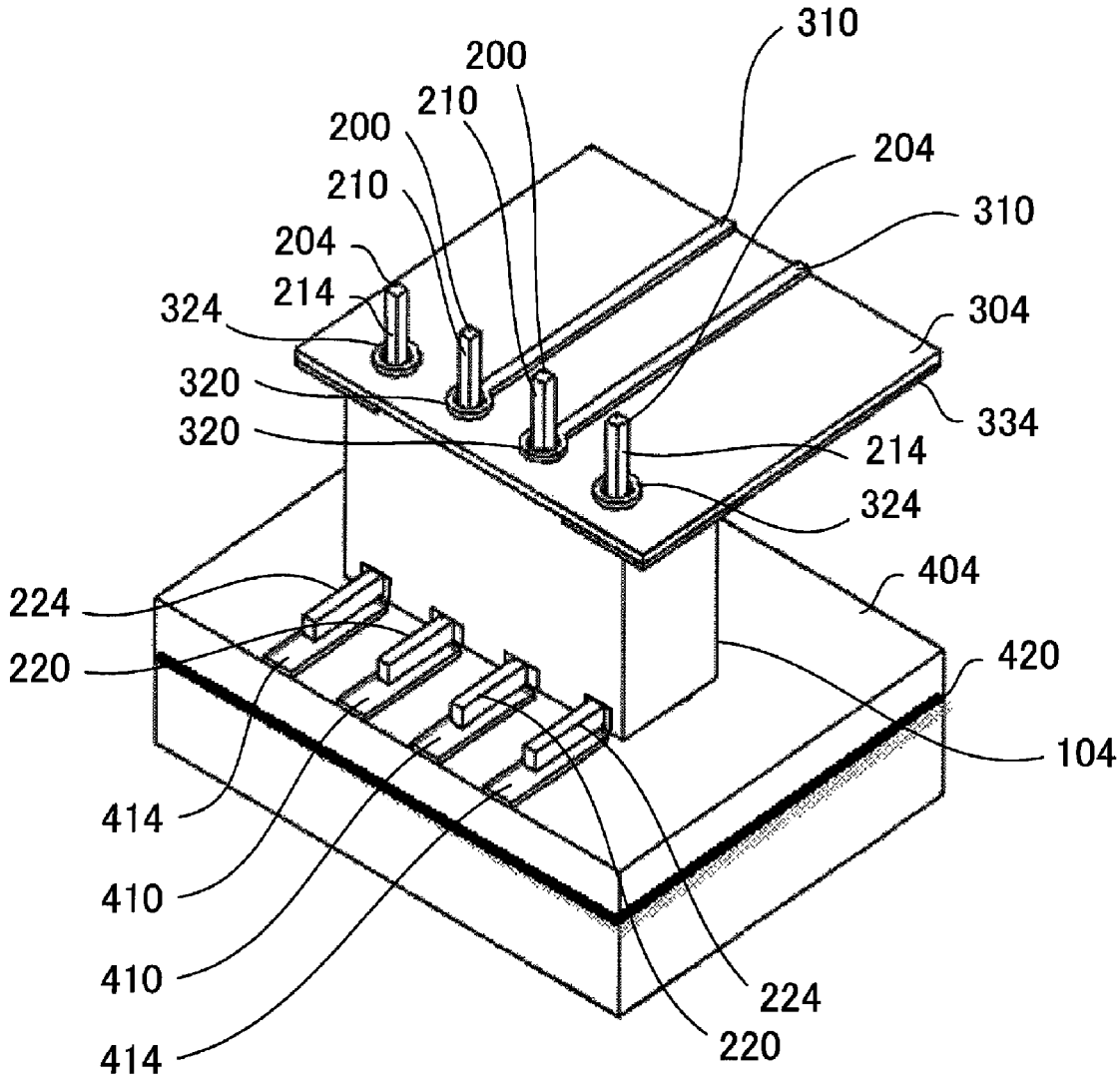
FIG. 17 is an oblique perspective view illustrating a connection state between the lead terminal and substrates according to a fifth embodiment.
Figure 18:
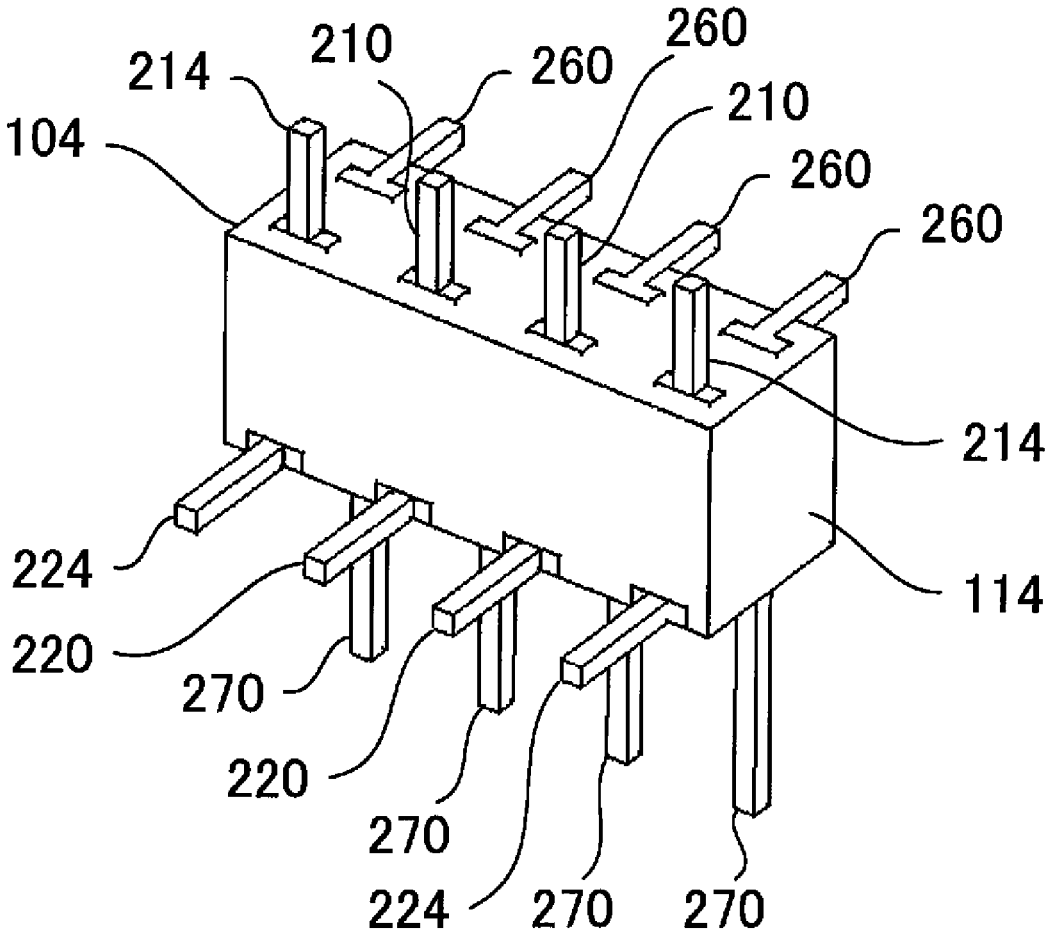
FIG. 18 is an oblique perspective view illustrating an appearance of the lead terminal according to the fifth embodiment.
Figure 19:
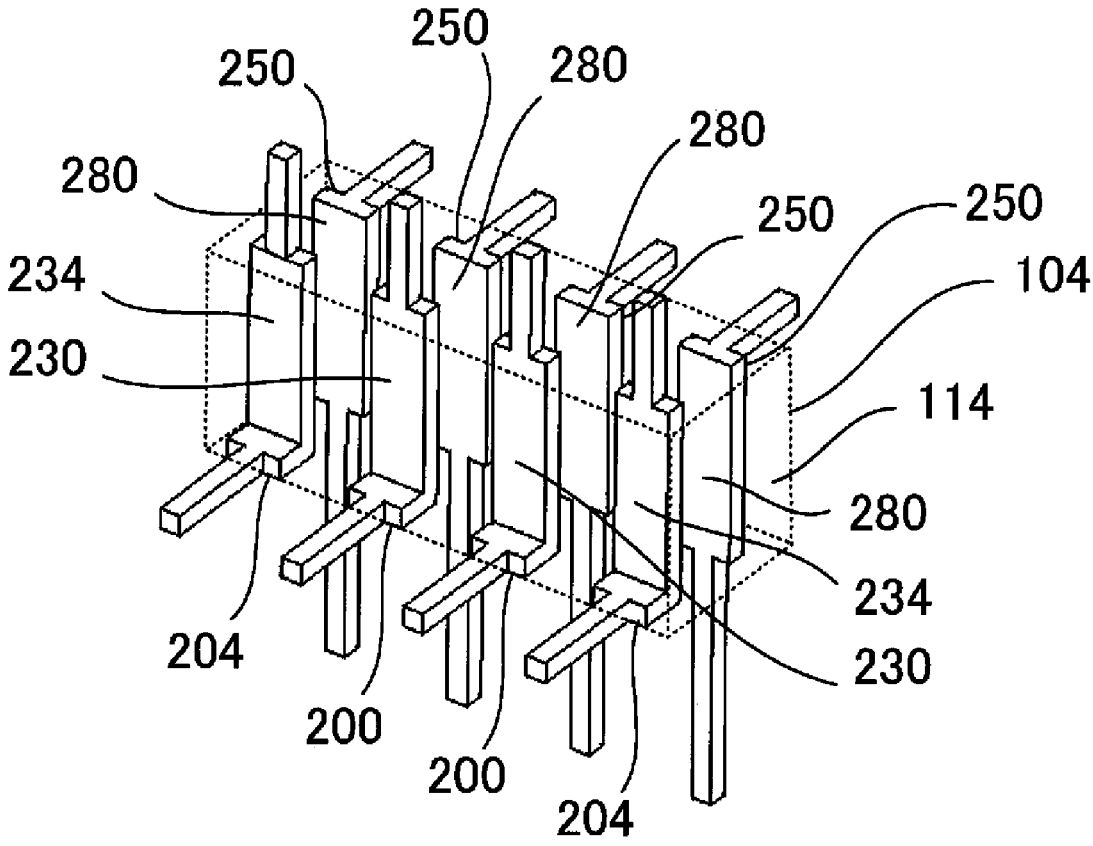
FIG. 19 is an oblique perspective view illustrating an internal structure of the lead terminal according to the fifth embodiment.

Next, a fifth embodiment will be described. Here, a transmission line having formed therein a grounded coplanar line on the rigid substrate 403 and the lead terminal 104 connected to the rigid substrate 403 will be described with reference to FIGS. 17, 18, and 19. FIG. 17 is an oblique perspective view illustrating a connection state between the lead terminal and substrates according to the fifth embodiment. To facilitate understanding of the connection state, FIG. 17 illustrates only a part of the flexible substrate 304 and the rigid substrate 404. FIG. 18 is an oblique perspective view illustrating an appearance of the lead terminal 104 according to the fifth embodiment. FIG. 19 is an oblique perspective view illustrating an internal structure of the lead terminal 104 according to the fifth embodiment.

The lead terminal 104 includes two pairs of the signal lead pins 200 and the GND lead pins 250, and includes two GND lead pins 204 in the same row as that of the signal lead pins 200 so as to interpose the signal lead pins 200 therebetween. The signal lead pin 200 includes the connections 210 and 220 to the substrate. The connection 210 is connected to the signal pattern 310 by the connection land 320 via an insertion hole of the flexible substrate 304. The connection 220 is connected to the signal pattern 410 on the rigid substrate 404. Meanwhile, the GND lead pin 250 is connected to the GND pattern 334 on the flexible substrate 304 by the connection 260 and connected to the GND pattern 420 in the rigid substrate 404 by the connection 270. Further, the GND lead pin 204 has connections 214 and 224 to the substrate. The connection 214 is connected to the GND pattern 334 by a connection land 324 via an insertion hole of the flexible substrate 304. The connection 224 is connected to a GND pattern 414 on the rigid substrate 404.

As described above, two signal patterns 410 are interposed between the GND patterns 414 and arranged in a layer different from that of the GND pattern 420, thereby forming a grounded coplanar line on the rigid substrate 404. Further, the two signal lead pins 200 are interposed between the GND lead pins 204, and the GND lead pins 250 that are paired to the signal lead pins 200 are arranged, thereby forming a grounded coplanar line in the lead terminal 104.

The lead terminal 104 embeds the main parts 230 of the two signal lead pins 200, the main parts 280 of the four GND lead pins 250, and the main parts 234 of the two GND lead pins 204 in the holding member 114, and holds the signal lead pins 200, the GND lead pins 250, and the GND lead pins 204. The holding member 114 has an appearance of rectangular parallelepiped, and the connections 210 of the two signal lead pins 200 and the connections 214 of the two GND lead pins 204 are protruded from the upper surface (contact surface with the flexible substrate 304) of the holding member 114. Further, the connections 260 of the four GND lead pins 250 are protruded from the back side while facing their connection surfaces toward the flexible substrate 304 from the upper surface of the holding member 114.

The connections 270 of the four GND lead pins 250 are protruded from the lower surface (contact surface with the rigid substrate 404) of the holding member 114. Further, the connections 220 of the two signal lead pins 200 and the connections 224 of the two GND lead pins 204 are protruded from a front side while facing their connection surfaces toward the rigid substrate 404 from the lower surface of the holding member 114.

The main parts 230 of the two signal lead pins 200 each face the main parts 280 of the two GND lead pins 250 to be paired at a constant distance. Since the space between the facing main parts 230 and main parts 280 is filled with the holding member 114, impedance of the grounded coplanar line formed in the lead terminal 104 is determined using as one of parameters a dielectric constant of the holding member 114. The holding member 114 is made of, for example, resin and includes a liquid crystal polymer (e.g., a dielectric constant of 3) more specifically. It is designed that the impedance of connections matches the impedance of a substrate to be connected.

In addition, the holding member 114 holds one row of the lead pins formed by the two signal lead pins 200 and the two GND lead pins 204, and another row of the lead pins formed by the four GND lead pins 250 at a constant distance.

Figure 20:
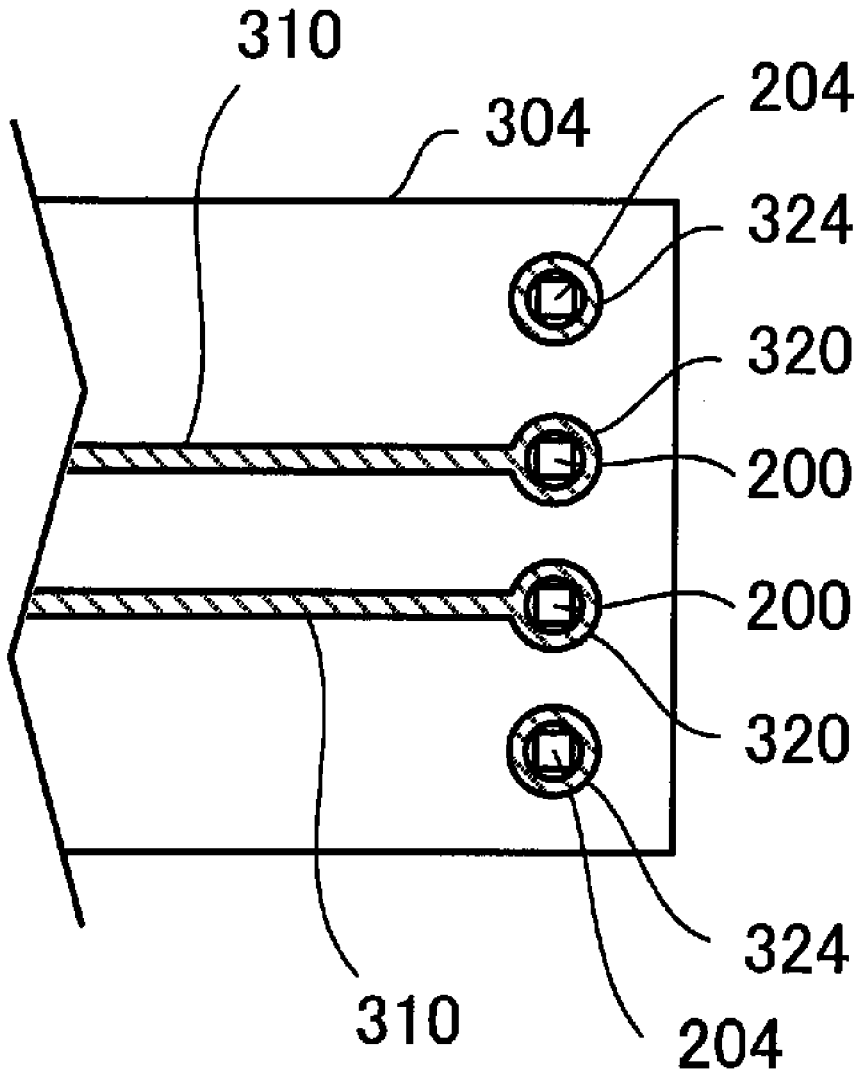
FIG. 20 is a wiring surface of signal lines on a flexible substrate according to the fifth embodiment.
Figure 21:
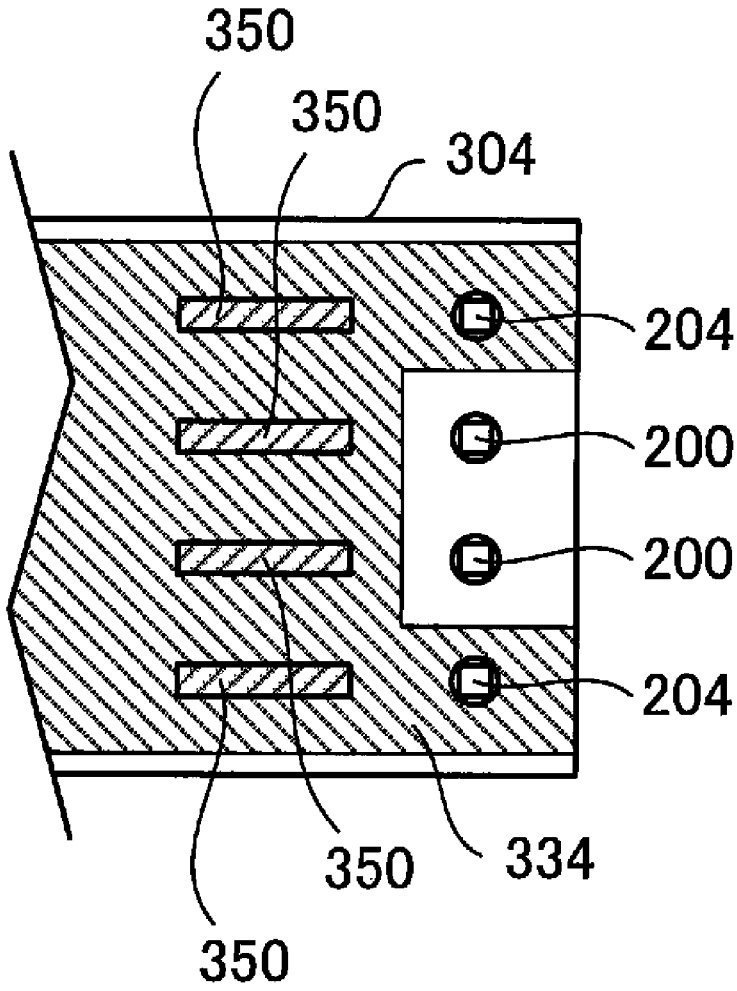
FIG. 21 is a wiring surface of a ground layer on the flexible substrate according to the fifth embodiment.

Next, the flexible substrate 304 according to the fifth embodiment will be described with reference to FIGS. 20 and 21. FIG. 20 is a wiring surface of signal lines on the flexible substrate 304 according to the fifth embodiment. FIG. 21 is a wiring surface of a ground layer on the flexible substrate 304 according to the fifth embodiment.

On the wiring surface of the signal patterns 310 on the flexible substrate 304, insertion holes for the connections 210 of the two signal lead pins 200 and the connections 214 of the two GND lead pins 204 are provided, and the connection lands 320 and 324 are provided around the insertion holes, respectively. When the connections 210 of the two signal lead pins 200 and the connections 214 of the two GND lead pins 204 are inserted into the insertion holes, the flexible substrate 304 and the lead terminal 104 are positioned. The connection land 320 is connected to the signal pattern 310. The connection land 324 fixes the connection 214 of the GND lead pin 204 and the flexible substrate 304 by soldering, and is connected so as to have conductivity with the GND pattern 334 on the flexible substrate 304.

On the wiring surface of the GND pattern 334 on the flexible substrate 304, the GND pattern 334 that is eliminated around the insertion holes for the two signal lead pins 200 is provided. On the GND pattern 334, footprints 350 for soldering the connections 260 of the four GND lead pins 250 are provided.

Figure 22:
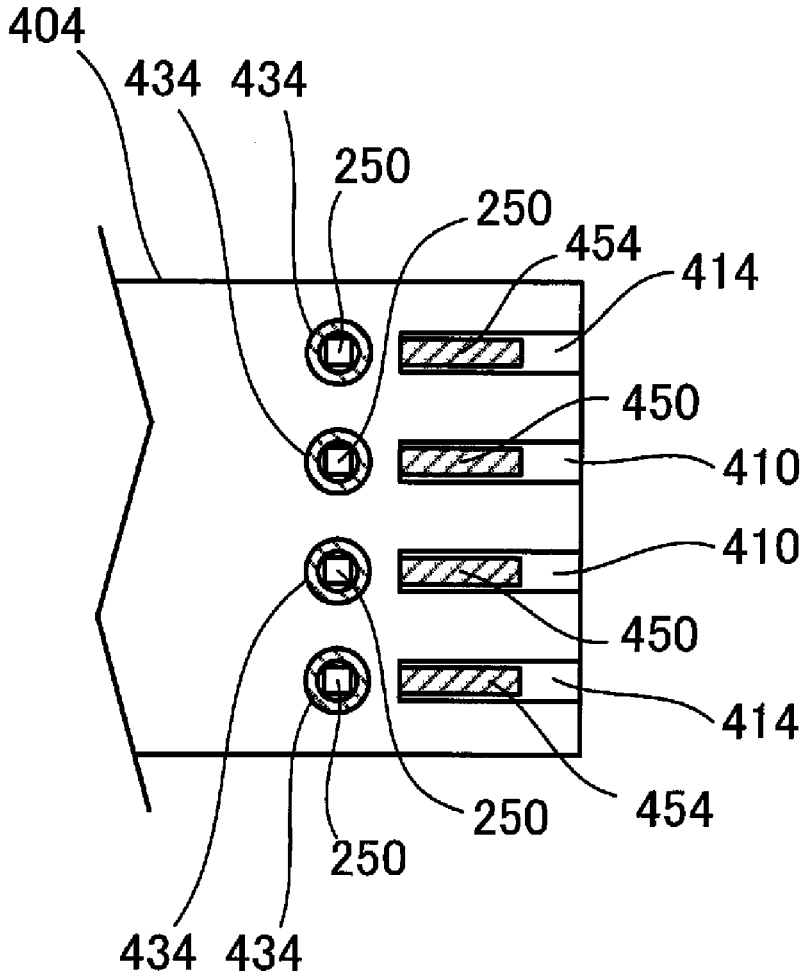
FIG. 22 is a wiring surface of signal lines on a rigid substrate according to the fifth embodiment.

Next, the rigid substrate 404 according to the fifth embodiment will be described with reference to FIG. 22. FIG. 22 is a wiring surface of signal lines on the rigid substrate 404 according to the fifth embodiment.

On the wiring surface of the signal patterns 410 on the rigid substrate 404, footprints 450 for soldering the connections 220 of the two signal lead pins 200 are provided. Further, on the wiring surface of the GND patterns 414 on the rigid substrate 404, footprints 454 for soldering the connections 224 of the two GND lead pins 204 are provided. On the wiring surface of the signal patterns 410 on the rigid substrate 404, insertion holes for the connections 270 of the four GND lead pins 250 and connection lands 434 for soldering the connections 270 to the rigid substrate 404 are provided. The connection land 434 is connected so as to have conductivity with the GND pattern (GND layer) via the via hole (not shown).

Figure 23:
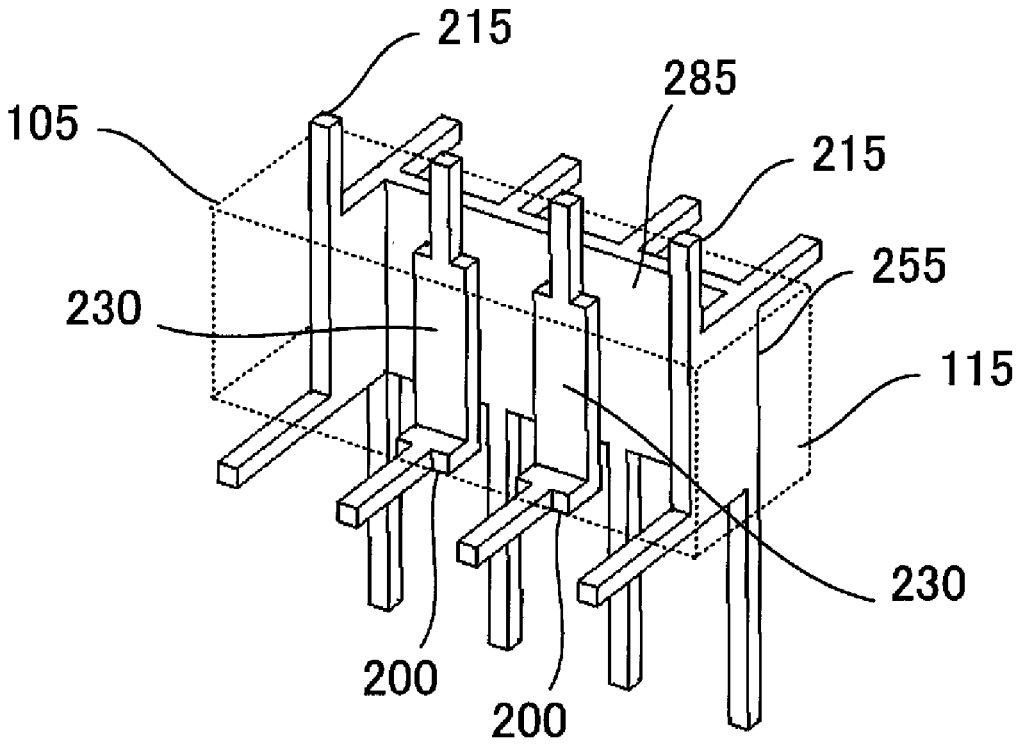
FIG. 23 is an oblique perspective view illustrating an internal structure of the lead terminal according to a sixth embodiment.

Next, a sixth embodiment will be described. An internal structure of the lead terminal will be described with reference to FIG. 23. FIG. 23 is an oblique perspective view illustrating an internal structure of the lead terminal according to the sixth embodiment.

The lead terminal 105 has the two signal lead pins 200 and a GND lead pin 255 that is paired to the two signal lead pins 200. The GND lead pin 255 has the same connection as those of the four GND lead pins 250 and the two GND lead pins 204 (refer to the fifth embodiment); however, differs from the GND lead pins 250 and 204 according to the fifth embodiment in that the main parts are integrated into one component. The GND lead pin 255 obtains a large ground region due to the above-described integration of the main part 285. The lead terminal 105 embeds the main parts 230 of the two signal lead pins 200 and the main part 285 of the GND lead pin 255 in the holding member 115, and holds the signal lead pins 200 and the GND lead pin 255.

In addition, when using the above-described GND lead pin 255, the connection land 324 of the flexible substrate 304 only fixes the connection 215 and the flexible substrate 304 by soldering, and can prevent the connection 215 from having conductivity with the GND pattern 334 on the flexible substrate 304.

Figure 24:
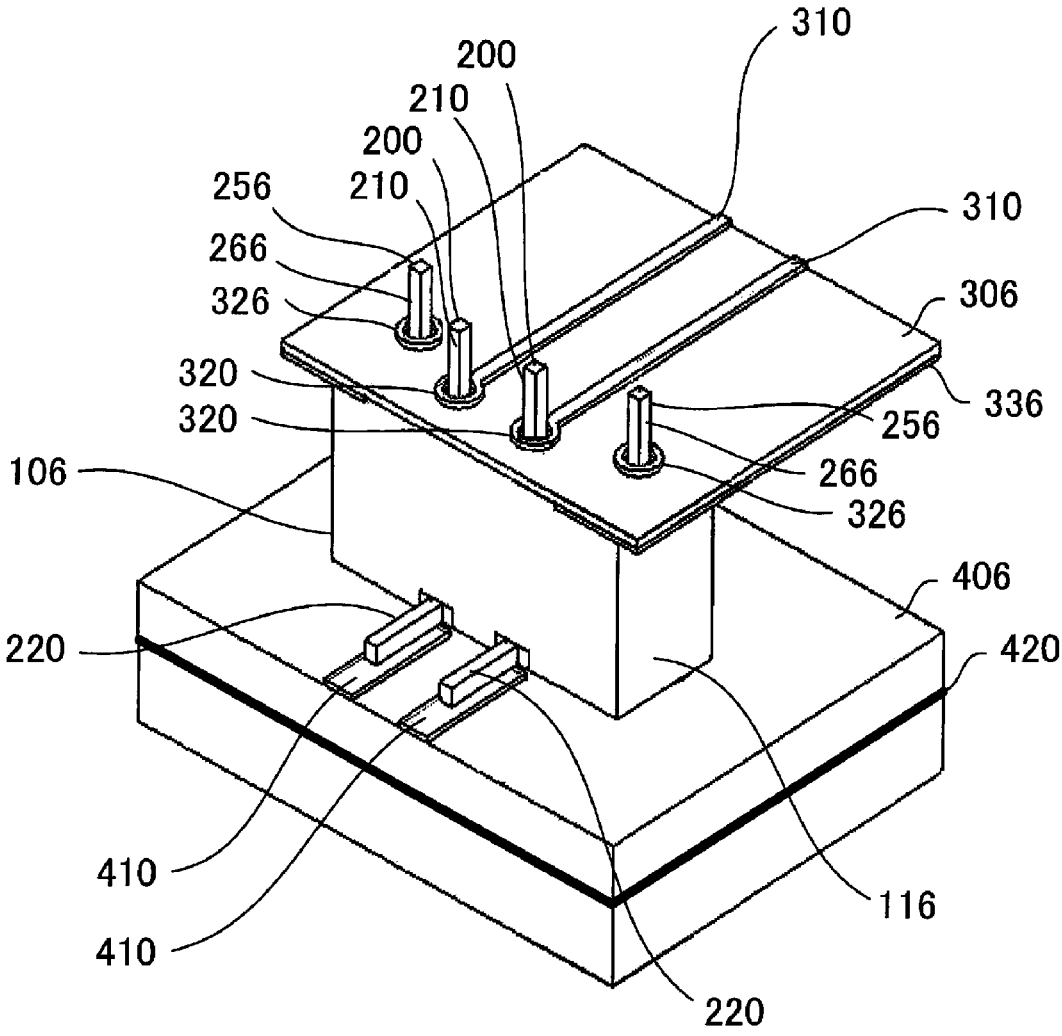
FIG. 24 is an oblique perspective view illustrating a connection state between the lead terminal and substrates according to a seventh embodiment.
Figure 25:
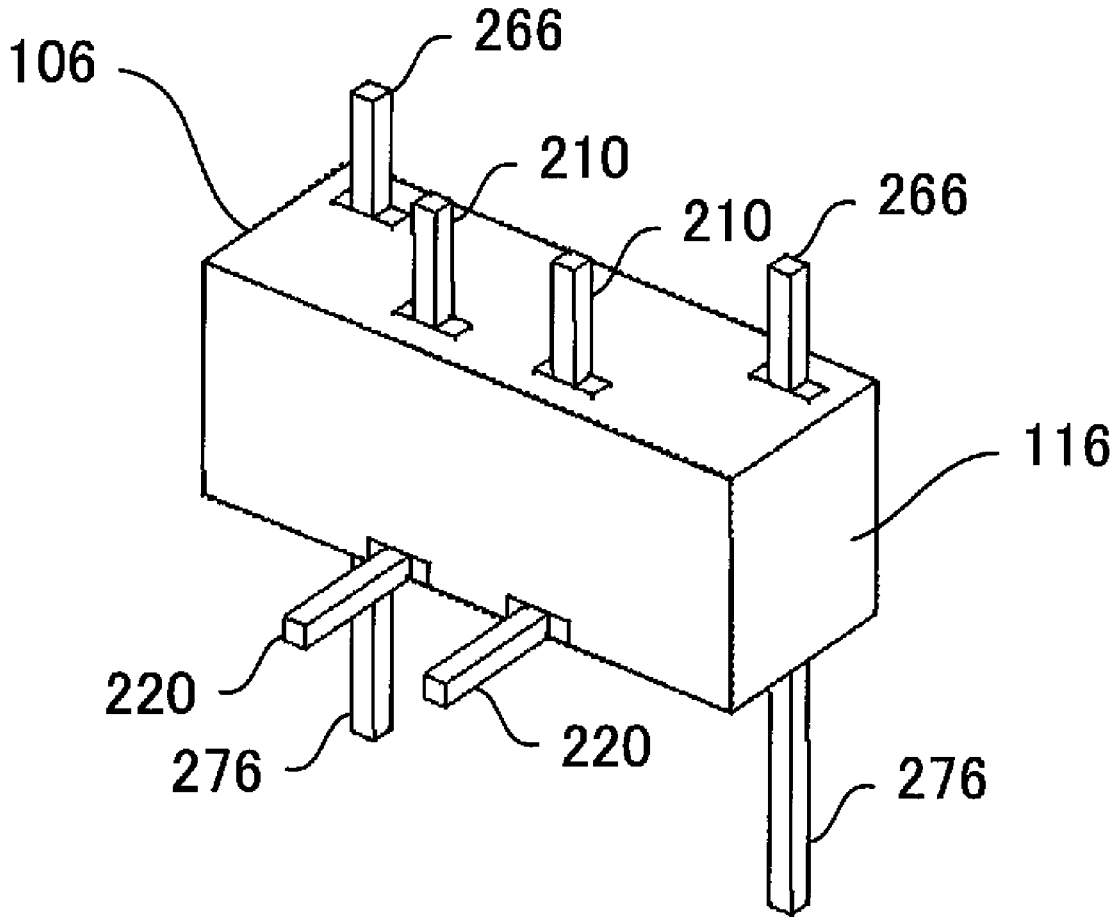
FIG. 25 is an oblique perspective view illustrating an appearance of the lead terminal according to the seventh embodiment.
Figure 26:
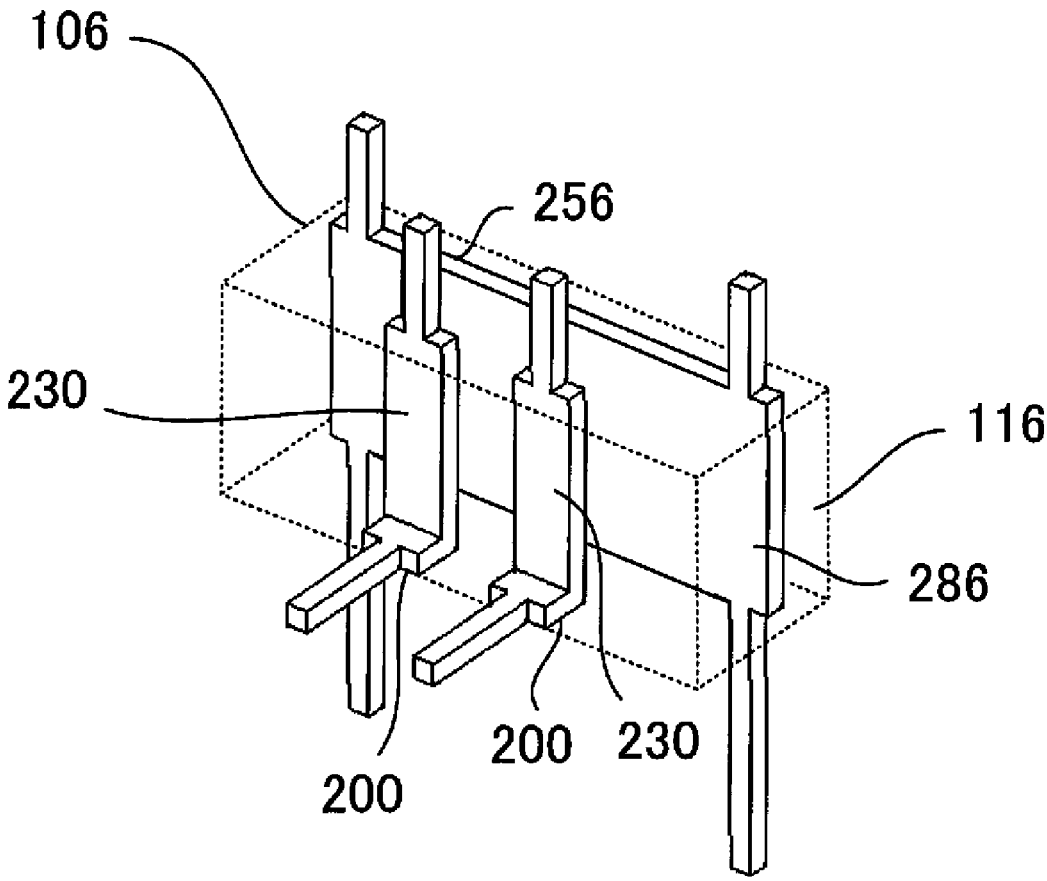
FIG. 26 is an oblique perspective view illustrating an internal structure of the lead terminal according to the seventh embodiment.

Next, a seventh embodiment will be described. Here, the lead terminal connected to the flexible substrate will be described with reference to FIGS. 24, 25, and 26. FIG. 24 is an oblique perspective view illustrating a connection state between the lead terminal and substrates according to the seventh embodiment. FIG. 25 is an oblique perspective view illustrating an appearance of the lead terminal according to the seventh embodiment. FIG. 26 is an oblique perspective view illustrating an internal structure of the lead terminal according to the seventh embodiment.

The lead terminal 106 has pairs of the signal lead pins 200 and the GND lead pin 256. The signal lead pin 200 has the connections 210 and 220 to the substrate. The connection 210 is connected to the signal pattern 310 by the connection land 320 via the insertion hole of the flexible substrate 306. The connection 220 is connected to the signal pattern 410 on the rigid substrate 406.

Meanwhile, the GND lead pin 256 is connected to the GND pattern 336 on the flexible substrate 306 by the connection 266, and connected to the GND pattern 420 in the rigid substrate 406 by the connection 276. The connection 266 is connected to the GND pattern 336 by a connection land 326 via the insertion hole of the flexible substrate 306.

This makes it possible to connect the lead terminal 106 and the flexible substrate 306 by soldering to a wiring surface on the GND pattern 336 on the flexible substrate 306.

The lead terminal 106 embeds the main parts 230 of the two signal lead pins 200 and the main part 286 of the GND lead pin 256 in the holding member 116, and holds the signal lead pins 200 and the GND lead pin 256. The holding member 116 has an appearance of rectangular parallelepiped, and the connections 210 of the two signal lead pins 200 and the two connections 266 of the GND lead pin 256 are protruded from the upper surface (contact surface with the flexible substrate 306) of the holding member 116.

Meanwhile, the two connections 276 of the GND lead pin 256 are protruded from a lower surface (contact surface with the rigid substrate 406) of the holding member 116. Further, the connections 220 of the two signal lead pins 200 are protruded from a front face while facing their connection surfaces toward the rigid substrate 406 from a lower surface of the holding member 116.

The main parts 230 of the two signal lead pins 200 face the main part 286 of the GND lead pin 256 to be paired at a constant distance. Since the space between the facing main parts 230 and 286 is filled with the holding member 116, impedance of a microstrip line formed in the lead terminal 106 is determined using as one of parameters a dielectric constant of the holding member 116. The holding member 116 is made of, for example, resin and includes a liquid crystal polymer (e.g., a dielectric constant of 3) more specifically. It is designed that the impedance of connections matches the impedance of a substrate to be connected.

The holding member 116 holds one row of the lead pins formed by the two signal lead pins 200 and another row of the lead pin formed by the connections 266 (or the connections 276) of the GND lead pin 256 at a constant distance.

Figure 27:
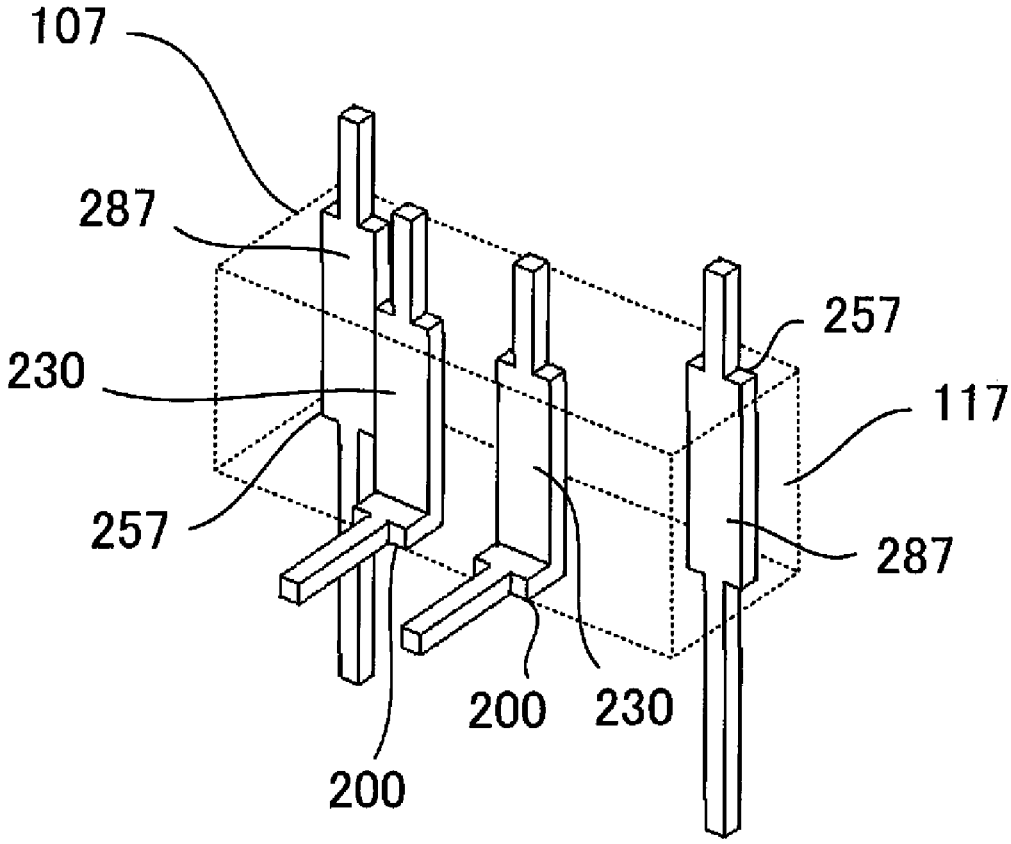
FIG. 27 is an oblique perspective view illustrating an internal structure of the lead terminal according to an eighth embodiment.

Next, an eighth embodiment will be described. An internal structure of the lead terminal will be described with reference to FIG. 27. FIG. 27 is an oblique perspective view illustrating an internal structure of the lead terminal according to the eighth embodiment.

The lead terminal 107 according to the eighth embodiment differs from the lead terminal 106 (refer to the seventh embodiment) in that the GND lead pin 256 of the lead terminal 106 is separated.

The lead terminal 107 has two pairs of the signal lead pins 200 and the GND lead pins 257. In the two signal lead pins 200 and the GND lead pins 257 to be paired, the main parts 230 and 287 face to each other at a constant distance while shifted in the left and right direction in the front view of its surface parts.

Accordingly, when a plurality of the GND lead pins 257 are integrated into one component (see, e.g., the GND lead pin 256 according to the seventh embodiment), there is no necessity of preparing the GND lead pins with different sizes of the main part corresponding to the number of pins.

The main part 287 may be set to place a disproportionate emphasis on one side with respect to a central axis obtained by connecting the connections in both ends of the GND lead pin 257. With respect to the central axis of the main part 287, one side of the main part 287 may be enlarged, for example, up to the front facing position of the main part 230.

Figure 28:
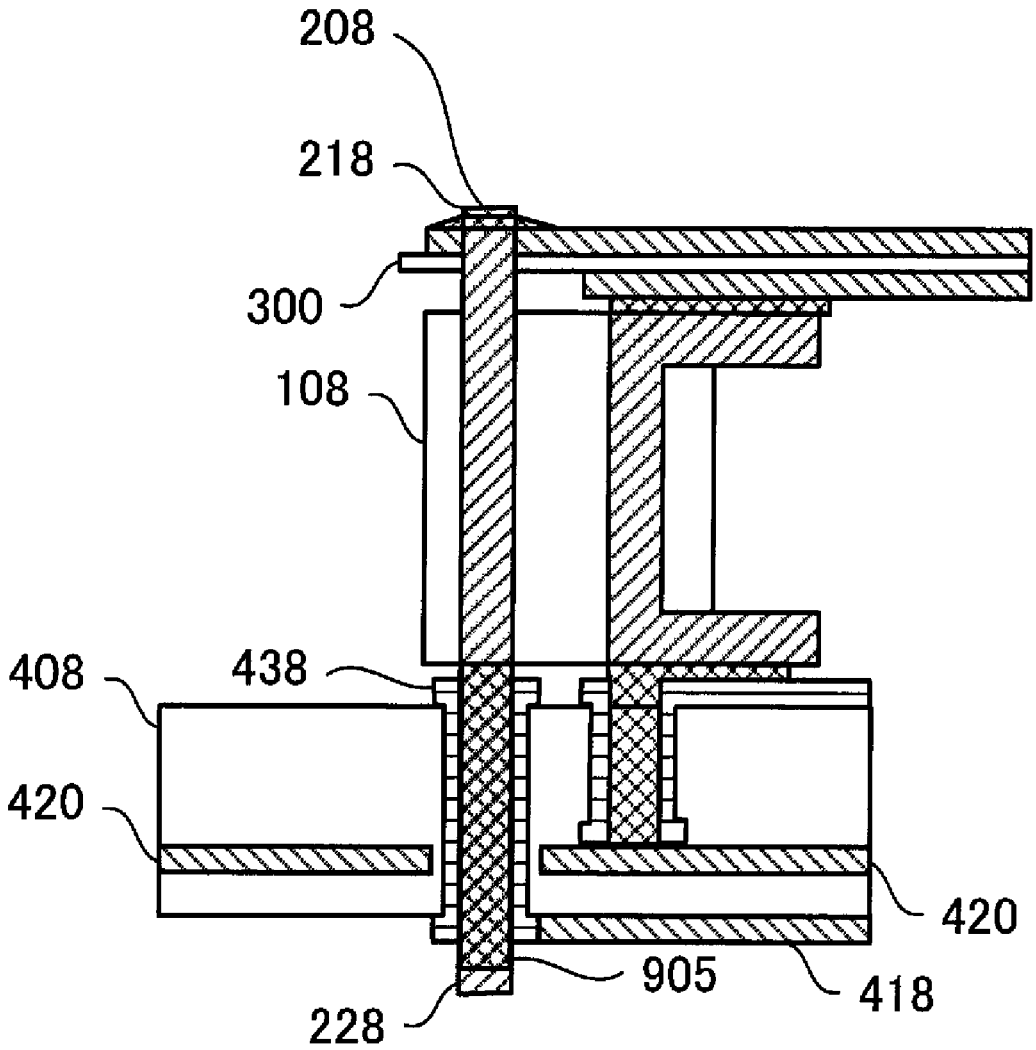
FIG. 28 is a schematic cross sectional view illustrating a connection state between the lead terminal and substrates according to a ninth embodiment.

Next, a ninth embodiment will be described. The lead terminal including the signal lead pins with no flection will be described with reference to FIG. 28. FIG. 28 is a schematic cross sectional view illustrating a connection state between the lead terminal and substrates according to the ninth embodiment.

The lead terminal 108 according to the ninth embodiment differs from the first embodiment in which the signal lead pin 200 of the lead terminal 100 (refer to the first embodiment) is surface-mounted on the rigid substrate 400 in that the signal lead pin 208 is inserted and mounted on the rigid substrate 408.

The connection 218 of the signal lead pin 208 is connected via an insertion hole of the flexible substrate 300, and the connection 228 is connected via a via hole 438 of the rigid substrate 408. Therefore, the signal lead pin 208 has no flection.

The connection 228 is fixed to the rigid substrate 408 by solder 905, and connected so as to have conductivity with a signal pattern 418 on the rigid substrate 408. In the rigid substrate 408, the signal pattern 418 and the GND pattern 420 form a microstrip line.

This process enables the signal lead pin 208 to be manufactured without bending work.

Figure 29:
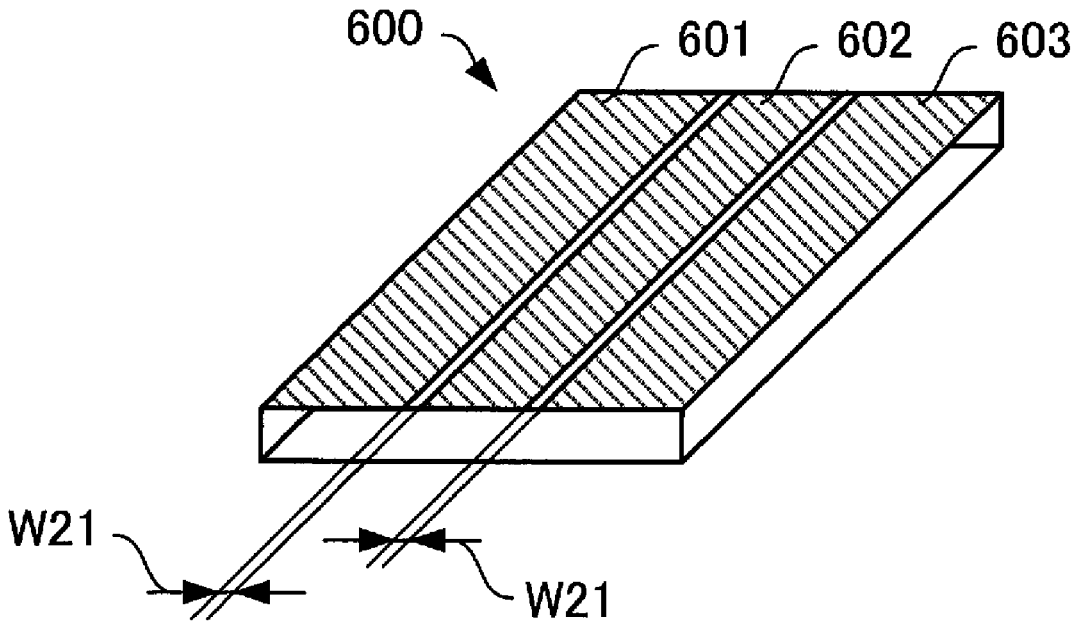
FIG. 29 illustrates a coplanar line.
Figure 30:
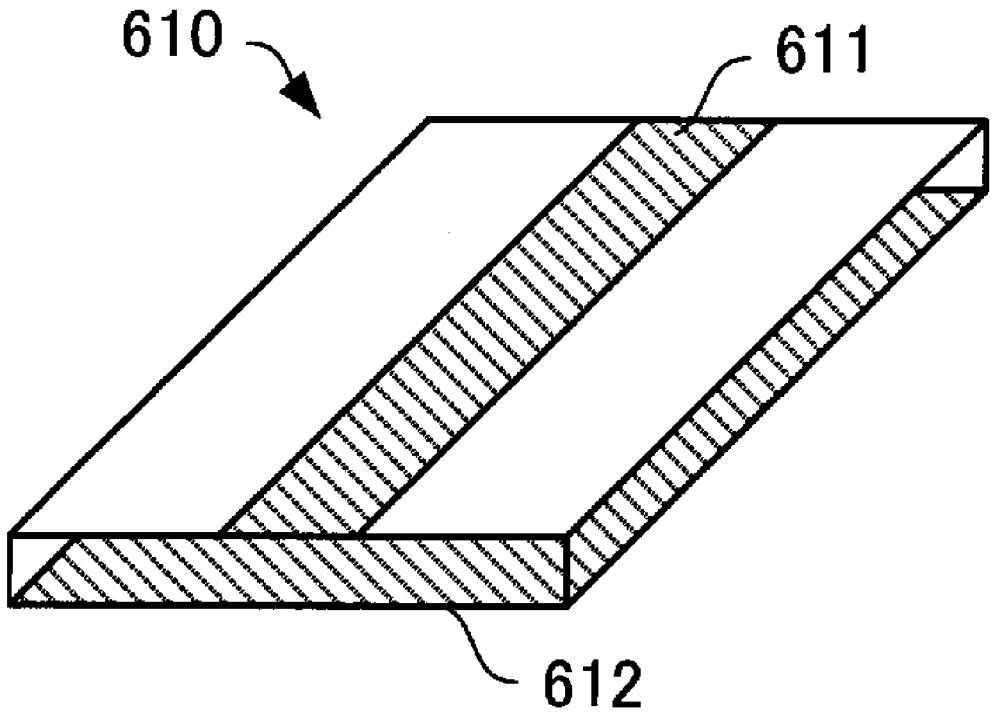
FIG. 30 illustrates a microstrip line.
Figure 31:
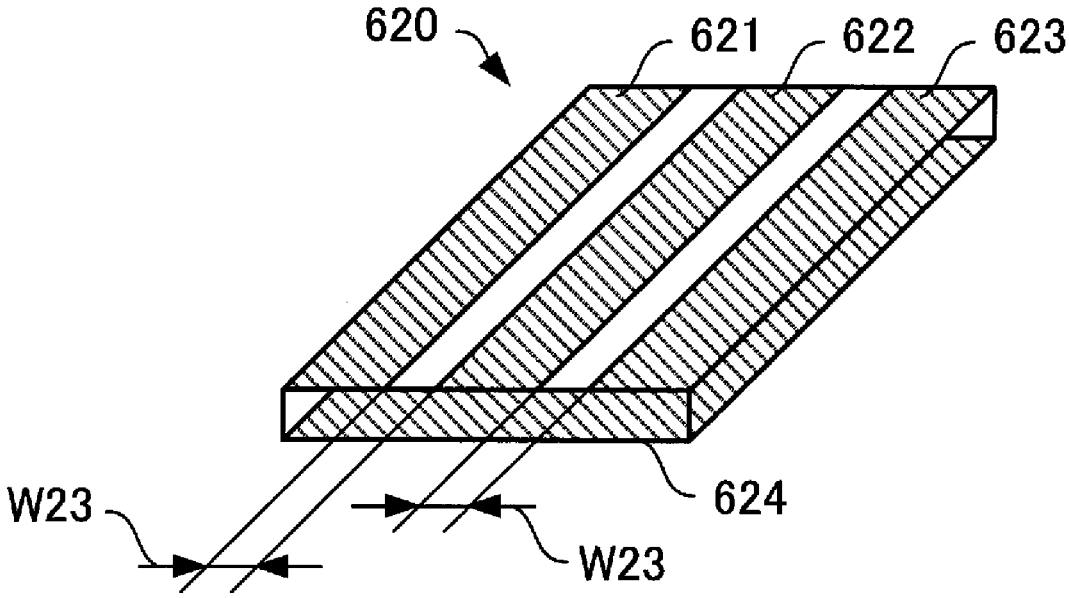
FIG. 31 illustrates a grounded coplanar line.

Here, the transmission line will be repeated. FIG. 29 illustrates a coplanar line. FIG. 30 illustrates a microstrip line. FIG. 31 illustrates a grounded coplanar line.

A coplanar line 600 is formed by using only one wiring layer. On the one wiring layer, a signal pattern 602 and GND patterns 601 and 603 on both sides of the signal pattern 602 are formed. A gap of width W 21 is provided between the signal pattern 602 and the GND pattern 601. Similarly, a gap of width W21 is provided between the signal pattern 602 and the GND pattern 603.

In the above-described coplanar line 600, since one wiring layer is formed, connection between the substrates becomes easy. However, since the width W21 is several dozen μm or less, alignment and soldering of the connection become difficult.

A microstrip line 610 is formed by using two wiring layers. On one wiring layer, a signal pattern 611 is formed. On both sides of the signal pattern 611, large gaps can be provided as compared with those of the coplanar line 600. On another wiring layer, a GND pattern (GND plane) 612 is formed.

In the above-described microstrip line 610, since two wiring layers are formed, connection between the substrates becomes difficult. However, since large gaps can be provided on both sides of the signal pattern 611, alignment and soldering of the connection become easy.

A grounded coplanar line 620 is formed by using two wiring layers. On one wiring layer, a signal pattern 622 and GND patterns 621 and 623 on both sides of the signal pattern 622 are formed. A gap of width W23 is provided between the signal pattern 622 and the GND pattern 621. Similarly, a gap of width W23 is provided between the signal pattern 622 and the GND pattern 623. Large gaps can be provided on both sides of the signal pattern 622 as compared with those of the coplanar line 600. On another wiring layer, a GND pattern (GND plane) 624 is formed.

In the above-described grounded coplanar line 620, since two wiring layers are formed, connection between the substrates becomes difficult. However, since large gaps can be provided on both sides of the signal pattern 622, alignment and soldering of the connection become easy.

Accordingly, as to the substrate to be connected to the lead terminal, the substrate on which a microstrip line or a grounded coplanar line is formed is preferably connected to the lead terminal.

In addition to the case of connecting two substrates each having a microstrip line formed thereon, the lead terminal according to the present embodiment is applicable to the case where a grounded coplanar line is formed on one substrate, and also the case where grounded coplanar lines are formed on both substrates.

This makes it possible to form a microstrip line or a grounded coplanar line within the lead terminal, on the connection between the lead terminal and the substrate, and on two substrates to be connected.

The case where the lead terminal connects the rigid substrate and the flexible substrate is described, and further, the lead terminal is applicable also to the case of connecting the substrates of the same type as in the rigid substrates or the flexible substrates.

Further, the lead terminal is described using as a multilayer substrate the rigid substrate and flexible substrate being a printed circuit board but not limited thereto. Further, regardless of the rigid substrate and the flexible substrate, the lead terminal may be described using other substrates, for example, a rigid flexible substrate or a film wiring material.

In the description of the present embodiment, the number of the lead pins to be formed in one row is described to be set to four; further, not limited thereto, and can be set to several dozen. In this case, a signal lead pin or GND lead pin that does not constitute the transmission line may be included. That is, one lead terminal can include a terminal group (a signal terminal and ground terminal that constitute the transmission line) that constitutes the transmission line and a terminal group (a terminal that does not constitute the transmission line (a signal terminal, a ground terminal, or an idle terminal)) that does not constitute the transmission line.

According to the proposed connection terminal and transmission line, preferable high-speed signal characteristics can be obtained with a simple structure.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present invention has(have) been described in detail, it should be understood that various changes, substitutions and alterations could be made hereto without departing from the spirit and scope of the invention.

What is claimed is:

1. A connection terminal, comprising:

a signal terminal that connects signal lines between a first multilayer substrate and a second multilayer substrate, the signal terminal including:

a first end portion to be connected on a surface of a first layer of the first multilayer substrate, and a second end portion to be inserted into a first insertion hole of the second multilayer substrate to connect to a second layer of the second multilayer substrate;

a ground terminal that connects ground lines between the first multilayer substrate and second multilayer substrate, the around terminal including:

a third end portion to be connected on a surface of a third layer of the second multilayer substrate, the third layer facing the first layer of the first multilayer substrate, and a fourth end portion to be inserted into a second insertion hole of the first multilayer substrate to connect to a fourth layer of the first multilayer substrate; and an insulating holding medium that holds the signal terminal and ground terminal in a pair, with a specified distance therebetween.

2. The connection terminal according to claim 1, wherein:

the signal terminal is provided in plurality;

the ground terminal is provided in plurality;

the insulating holding medium aligns the signal terminals in a first row, as well as the ground terminals in a second row in parallel with the first row, in such a way that the signal terminals and ground terminals are arranged in pairs; and the ground terminals are connected together inside the insulating holding medium.

3. The connection terminal according to claim 1, wherein a difference in height between the second end portion and the third end portion, relative to an end face of the insulating holding medium, is larger than a distance between the second and third layers of the second multilayer substrate.

4. The connection terminal according to claim 1, wherein a terminal width of the first end portion is narrower than a wiring line width of the first multilayer substrate.

5. The connection terminal according to claim 4, wherein:

the first end portion includes a bent portion that is bent along the surface of the first layer of the first multilayer substrate; and the third end portion is bent along the surface of the third layer of the second multilayer substrate.

6. The connection terminal according to claim 5, wherein:

the bent portion of the first end portion includes a connection surface connected to the surface of the first layer; and the insulating holding medium includes an end face that faces the first layer of the first multilayer substrate and is level with the connection surface of the bent portion.

7. A transmission line, comprising:

a first multilayer substrate including a first terminal insertion hole and first and second layers in which a first signal line and a first ground line are respectively arranged;

a second multilayer substrate including a second terminal insertion hole and third and fourth layers in which a second signal line and a second ground line are respectively arranged; and a connection terminal that connects the first and second multilayer substrates, the connection terminal including:

a signal terminal that connects the first and second signal lines, the signal terminal including:

a first end portion to be connected on a surface of the first layer of the first multilayer substrate, and a second end portion to be inserted into the second insertion hole of the second multilayer substrate to connect to the fourth layer of the second multilayer substrate, a ground terminal that connects the first and second ground lines the ground terminal including:

a third end portion to be connected on a surface of the third layer of the second multilayer substrate, the third layer facing the first layer of the first multilayer substrate, and a fourth end portion to be inserted into the first insertion hole of the first multilayer substrate to connect to the second layer of the first multilayer substrate, and an insulating holding medium that holds the signal terminal and ground terminal in a pair, with a specified distance therebetween.

8. The transmission line according to claim 7, wherein the insulating holding medium is formed by a liquid crystal polymer.

* * * * *